US012460640B2

(12) United States Patent
Gray et al.

(10) Patent No.: US 12,460,640 B2
(45) Date of Patent: Nov. 4, 2025

(54) COMPLEX SCREW ROTORS WITH A CENTRAL CIRCULAR CROSS SECTION CONNECTING RIGHT-HAND AND LEFT-HAND SECTIONS OF THE ROTORS

(71) Applicant: Industrial Technologies and Services, LLC, Davidson, NC (US)

(72) Inventors: Luke Gray, Loraine, IL (US); Taylor Stratman, Quincy, IL (US); Bernard Conley, Palmyra, MO (US); Brent Ransdell, Warsaw, MO (US); Daniel Peana, Springfield, MO (US)

(73) Assignee: Industrial Technologies and Services, LLC, Davidson, NC (US)

( * ) Notice: Subject to any disclaimer, the term of this patent is extended or adjusted under 35 U.S.C. 154(b) by 0 days.

(21) Appl. No.: 18/821,391

(22) Filed: Aug. 30, 2024

(65) Prior Publication Data

US 2024/0426298 A1 Dec. 26, 2024

Related U.S. Application Data

(63) Continuation of application No. 18/312,057, filed on May 4, 2023, now Pat. No. 12,110,888, which is a (Continued)

(51) Int. Cl.

| | |
|---|---|
| ***F04C 18/08*** | (2006.01) |
| ***F04C 18/16*** | (2006.01) |
| ***F04C 18/20*** | (2006.01) |

(52) U.S. Cl.

CPC ..... *F04C 18/084* (2013.01); *F04C 18/088* (2013.01); *F04C 18/16* (2013.01);

(Continued)

(58) Field of Classification Search

CPC ..... F04C 18/084; F04C 18/088; F04C 18/16; F04C 18/20; F04C 2240/20

See application file for complete search history.

(56) References Cited

U.S. PATENT DOCUMENTS 1,534,182 A 4/1925 John
1,708,891 A 4/1929 Josef (Continued)

FOREIGN PATENT DOCUMENTS

AU 2003257923 A1 11/2003
CN 1444700 A 9/2003

(Continued)

OTHER PUBLICATIONS

Chinese Patent Office Action for Application No. 201680063659.9, dated Jun. 4, 2019.

(Continued)

*Primary Examiner* — Mary A Davis

(74) *Attorney, Agent, or Firm* — Kevin E. West; Advent, LLP

(57) ABSTRACT

A compressor design includes a male rotor (10) having one or more helical lobes (12) and a female rotor (14) having one or more helical grooves (16). The male rotor is mounted on a first shaft and the female rotor is mounted on a second shaft. The male rotor is positioned in a first section of a chamber and the female rotor is positioned in a second section of the chamber. Fluid enters the chamber at an inlet, and when the rotors are driven, the lobes of the male rotor fit into the grooves of the female rotor, causing compression and movement of the fluid towards an outlet or discharge end where the compressed fluid is discharged. The configuration of the lobe and groove helix, the lobe and groove profile, and the outer diameter of the rotors can be varied in different combinations to form different rotors.

10 Claims, 31 Drawing Sheets

Related U.S. Application Data continuation of application No. 17/229,331, filed on Apr. 13, 2021, now Pat. No. 11,644,034, which is a continuation of application No. 15/760,086, filed as application No. PCT/US2016/059613 on Oct. 29, 2016, now Pat. No. 10,975,867.

(60) Provisional application No. 62/248,858, filed on Oct. 30, 2015, provisional application No. 62/248,785, filed on Oct. 30, 2015, provisional application No. 62/248,832, filed on Oct. 30, 2015, provisional application No. 62/248,811, filed on Oct. 30, 2015.

(52) U.S. Cl.
CPC ..... *F04C 18/20* (2013.01); *F04C 2240/20* (2013.01); *F04C 2250/201* (2013.01)

(56) References Cited

U.S. PATENT DOCUMENTS

| | | | | |
|---|---|---|---|---|
| 2,078,334 | A | 4/1937 | Martocello | |
| 2,543,894 | A | 3/1951 | Roberto | |
| 2,701,683 | A | 2/1955 | Whitfield | |
| 3,314,597 | A | 4/1967 | Benedictus et al. | |
| 3,424,373 | A | 1/1969 | Gardner et al. | |
| 3,535,057 | A | 10/1970 | Kodra et al. | |
| 3,558,248 | A | 1/1971 | Parker et al. | |
| 3,807,911 | A | 4/1974 | Caffrey | |
| 3,913,346 | A | 10/1975 | Moody, Jr. et al. | |
| 3,977,818 | A | 8/1976 | Sprankle | |
| 4,560,333 | A | 12/1985 | Fujiwara et al. | |
| 4,808,095 | A | 2/1989 | Nishitani et al. | |
| 5,066,205 | A | 11/1991 | Ingalls | |
| 5,393,209 | A | 2/1995 | Mohr et al. | |
| 5,580,232 | A | 12/1996 | McEndarfer | |
| 6,312,242 | B1 | 11/2001 | Fang et al. | |
| 6,447,276 | B1 | 9/2002 | Becher | |
| 6,474,950 | B1 | 11/2002 | Waldo | |
| 6,644,045 | B1 | 11/2003 | Tang et al. | |
| 7,997,092 | B2 | 8/2011 | Lifson et al. | |
| 12,110,888 | B2 * | 10/2024 | Gray | F04C 18/088 |
| 2003/0012675 | A1 | 1/2003 | Perna | |
| 2003/0152475 | A1 | 8/2003 | Becher | |
| 2003/0223897 | A1 | 12/2003 | Ferentinos | |
| 2005/0169789 | A1 | 8/2005 | Okada | |
| 2006/0039805 | A1 | 2/2006 | Gotou et al. | |
| 2006/0196184 | A1 | 9/2006 | Sprankle | |
| 2007/0077162 | A1 | 4/2007 | Tanaka et al. | |
| 2007/0207050 | A1 | 9/2007 | Ohmi | |
| 2007/0241627 | A1 | 10/2007 | Kharsa | |
| 2008/0181803 | A1 | 7/2008 | Weinbrecht | |
| 2009/0098003 | A1 | 4/2009 | Kothnur et al. | |

FOREIGN PATENT DOCUMENTS

| | | | |
|---|---|---|---|
| DE | 2329800 | A1 | 1/1974 |
| DE | 10334484 | A1 | 3/2005 |
| DE | 102008019449 | A1 | 10/2008 |
| EP | 1111243 | A2 | 6/2001 |
| EP | 1134357 | A2 | 9/2001 |
| EP | 2199611 | A2 | 6/2010 |
| FR | 953057 | A | 11/1949 |
| FR | 1528286 | A | 6/1968 |
| FR | 2888895 | A3 | 1/2007 |
| GB | 525760 | A | 9/1940 |
| GB | 1349218 | A | 4/1974 |
| JP | S60216089 | A | 10/1985 |
| JP | S63124801 | A | 5/1988 |
| JP | H01163486 | A | 6/1989 |
| JP | 2001140784 | A | 5/2001 |
| JP | 2002013494 | A | 1/2002 |
| JP | 2002168184 | A | 6/2002 |
| KR | 20000069459 | A | 11/2000 |
| SU | 1333846 | A1 | 8/1987 |
| WO | 02075117 | A1 | 9/2002 |
| WO | 03098048 | A1 | 11/2003 |
| WO | 2005047706 | A1 | 5/2005 |
| WO | 2006099104 | A2 | 9/2006 |
| WO | 2007068973 | A1 | 6/2007 |
| WO | 2010013981 | A2 | 2/2010 |
| WO | 2013057761 | A1 | 4/2013 |
| WO | 2013156789 | A2 | 10/2013 |
| WO | 2014191362 | A1 | 12/2014 |

OTHER PUBLICATIONS

Decision to grant in Korea for Application No. 10-2018-7012255, dated Jun. 1, 2023.
European Patent Office Action for Application No. 16794865.2, dated Jun. 7, 2019.
Examination Report for Australian Application No. 2016343830, dated May 4, 2021.
Examination Report for Indian Application No. 201817010327, dated Mar. 16, 2021.
Examination Report from Australian Application No. 2022202212, dated Aug. 18, 2023.
Examination Report in India for Application No. 202118041387, dated Apr. 8, 2022.
Examination report No. 1 for standard patent application No. 2022202212, dated Jul. 21, 2023.
Extended European Search Report from European Application No. 241878949.5, dated Aug. 28, 2024.
Extended European Search Report issued by the European Patent Office for Application No. 20162866.6, dated May 4, 2020.
International Search Report and Written Opinion for Application No. PCT/US2016/059613, dated Mar. 29, 2017.
Kauder, et al., "Optimierung geometrisher und thermodynamishcher Kenngrossen vo Schraubenladern," VDI Reports 1135, Oct. 1994, pp. 261-286.
Notice of Acceptance for Australian Patent Application No. 2022202212, dated May 3, 2024.
Office Action for Canadian Patent Application No. 3,179,438, dated Apr. 22, 2024.
Office Action in Canada for Application No. 3,003,677, dated Jun. 30, 2022.
Office Action in Korea for Application No. 10-2018-7012255, dated Jul. 7, 2022.
Summons to attend oral proceedings pursuant to Rule 115(1) EPC for Application No. 20162866.6, dated Jun. 21, 2023.
Weckes, "Ein Beitrag zur Optimierung geometrischer und thermodynamischer Kenngrossen von Schraubenladern," Faculty Mechanical Engineering, University Dortmund, 1994, Hannover, Germany.
You, et al., "Optimum Rotor Geometrical Parameters in Refrigeration Helical Twin Screw Compressors," Purdue Univ. e-pubs, 1966, pp. 027/069-033/069.

* cited by examiner

COMPLEX SCREW ROTORS WITH A CENTRAL CIRCULAR CROSS SECTION CONNECTING RIGHT-HAND AND LEFT-HAND SECTIONS OF THE ROTORS

CROSS-REFERENCE TO RELATED APPLICATIONS

The present application is a continuation under 35 U.S.C. § 120 of U.S. patent application Ser. No. 18/312,057, filed May 4, 2023, and titled "COMPLEX SCREW ROTORS," which in turn is a continuation of U.S. patent application Ser. No. 17/229,331, filed Apr. 13, 2021, and titled "COMPLEX SCREW ROTORS," which in turn is a continuation of U.S. patent application Ser. No. 15/760,086, filed Mar. 14, 2018, and titled "COMPLEX SCREW ROTORS," which in turn is a U.S. national stage entry of International Patent Application No. PCT/US2016/059613, filed on Oct. 29, 2016, which claims priority to U.S. Patent Application Nos. 62/248,785, 62/248,811, 62/248,832 and 62/248,858, filed on Oct. 30, 2015, the entire contents of all of which are fully incorporated herein by reference.

FIELD

Various exemplary embodiments relate to screw compressor rotors used to compress fluids.

BACKGROUND

Rotary screw compressors typically include two or more intermeshing rotors positioned in a housing. A male rotor includes one or more lobes that mate with grooves of a female rotor. The housing defines a chamber in which the male and female rotors are positioned. The chamber is dimensioned closely with the outer diameters of the male and female rotor, generally shaped as a pair of cylinders that are parallel and intersecting. An inlet is provided for the introduction of fluid to the rotors and an outlet is provided for discharging the compressed fluid.

The rotors include a driving mechanism, for example gears, that drive and synchronize the movement of the male and female rotors. During rotation, the intermeshing male and female rotors form cells of varying sizes to first receive the inlet fluid and then compress, thus increasing the pressure of, the fluid as it moves toward the outlet. Dry compressors can utilize one or more gears connected to a shaft to drive and synchronize rotation of the rotors. Wet compressors can utilize a fluid, for example oil, to space and driver the rotors.

The profiles of the male and female rotors can be generated a number of ways. One way is to define one of the two rotors and then derive the other profile using conjugation. Another method includes defining a rack curve for the rotors, and using the rack curve to define the male and female rotors. This method is described, for example in: U.S. Pat. No. 4,643,654; WO 97/43550; and GB 2,418,455. Another method of defining male and female rotor profiles by enveloping a rack curve is described in U.S. Pat. No. 8,702,409, the disclosure of which is hereby incorporated by reference in its entirety.

SUMMARY

Various exemplary embodiments relate to a screw compressor or expander having a female rotor including a first section having a right-hand first groove and a second section having a left-hand second groove. The first groove has a first variable helix, the second groove has a second variable helix, and the female rotor has a first variable profile and a first variable outer diameter. A male rotor includes a third section having a left-hand first lobe and a fourth section having a right-hand second lobe. The first lobe has a third variable helix, the second lobe has a fourth variable helix, and the male rotor has a second variable profile and a second variable outer diameter.

Various exemplary embodiments relate to a screw compressor or expander having a female rotor including a first section, a second section, and a first central section. The first section having a set of right-hand first grooves, the second section having a set of left-hand second grooves corresponding to the set of first grooves. The first grooves have a first variable helix, the second grooves have a second variable helix, and the female rotor has a first variable profile. A male rotor includes a third section, a fourth section, and a second central section positioned between the third and fourth sections. The third section having a set of left-hand first lobes and the fourth section having a set of right-hand second lobes corresponding to the set of first lobes. The first lobes have a third variable helix, the second lobes have a fourth variable helix, and the male rotor has a second variable profile. The female rotor transitions to a substantially circular cross section at the first central section and the male rotor transitions to a substantially circular cross section at the second central section.

Various exemplary embodiments relate to a screw compressor or expander having a female rotor including a first section having a first groove with a right-hand first variable helical profile and a second section having a second groove with a left-hand second variable helical profile. A male rotor including a third section having a first lobe with a right-hand third variable helical profile and a fourth section having a second lobe with a left-hand fourth variable helical profile.

Various exemplary embodiments relate to a screw compressor or expander including a male rotor having a first axial length extending from an inlet portion to an outlet portion and a set of lobes with a variable profile extending along the first axial length. A female rotor having a second axial length extending from the inlet portion to the outlet portion and a set of grooves with a variable profile extending along the second axial length. The set of grooves mating with the set of lobes. At least a portion of the male rotor and the female rotor each have a non-cylindrical configuration with a non-constant outer diameter.

Various exemplary embodiments relate to a screw compressor or expander including a male rotor having a first axial length extending from an inlet portion to an outlet portion and a set of lobes with a variable profile extending along at least a portion of the first axial length. A female rotor having a second axial length extending from the inlet portion to the outlet portion and a set of grooves with a variable profile extending along at least a portion of the second axial length, the set of grooves mating with the set of lobes. The male rotor and the female rotor transition to a substantially circular cross section near the outlet portion.

Various exemplary embodiments relate to a screw compressor or expander including a male rotor having a first axial length extending from an inlet portion to an outlet portion and a set of lobes extending along at least a portion of the first axial length. A female rotor having a second axial length extending from the inlet portion to the outlet portion and a set of grooves extending along at least a portion of the second axial length, the set of grooves mating with the set of lobes. The male rotor and the female rotor have a first section with a first profile defined by a first rack having a first set of X and Y coordinates and a second section with a second profile defined by a second rack different than the first rack having a second set of X and Y coordinates.

Various exemplary embodiments relate to a method of designing a set of screw compressor or expander rotors. A first rack is established for a male and female rotor. The first rack having at least one curved segment with a first crest having a first set of X and Y coordinates. The first rack is scaled in the X and Y directions to create a second rack having at least one curved segment with a second crest having a second set of X and Y coordinates. The X coordinate of the second crest is spaced from the X coordinate of the first crest.

Various exemplary embodiments relate to a method of designing a set of screw compressor or expander rotors. A first rack is established for a male and female rotor. The first rack having at least one curved segment with a first crest having a first set of a X and Y coordinates. A second rack is established for a male and female rotor. The second rack having at least one curved segment with a second crest having a second set of a X and Y coordinates, wherein the X coordinate of the second crest is spaced from the X coordinate of the first crest.

Various exemplary embodiments relate to a screw compressor or expander including a male rotor having a first axial length and a set of lobes with a first helical profile extending along the first axial length. A female rotor having a second axial length and a set of grooves with a second helical profile extending along the second axial length. The set of grooves mating with the set of lobes. The first helical profile is non-continuously variable over the first axial length.

Various exemplary embodiments relate to a screw compressor or expander including a male rotor having a lobe with a first helical profile extending between a first position proximate to an inlet portion and a second position proximate an outlet portion. A female rotor having a groove with a second helical profile extending between a third position proximate an inlet portion and a fourth position proximate an outlet portion, the groove mating with the lobes. A wrap-angle curve of the male rotor lobe includes a convex portion.

Various exemplary embodiments relate to a screw compressor or expander including a female rotor including a first section having a first groove with a right-hand helical profile, a second section having a second groove with a left-hand helical profile, and a first central section having a first curved transition connecting the first and second groove. A male rotor including a third section having a first lobe with a right-hand helical profile, a fourth section having a second lobe with a left-hand helical profile, and a second central section having a second curved transition connecting the first and second lobes.

Various exemplary embodiments relate to a screw compressor or expander including a female rotor including a first section having a first groove with a right-hand helical profile, a second section having a second groove with a left-hand helical profile, and a first central section. A male rotor including a third section having a first lobe with a right-hand helical profile, a fourth section having a second lobe with a left-hand helical profile, and a second central section. One of the first and second central sections includes a pocket.

Various exemplary embodiments relate to a screw compressor or expander including a housing having an inlet port, a discharge port, and a body at least partially defining a compression chamber having a first portion and a second portion. A female rotor rotatably positioned in the first portion of the compression chamber, the female rotor including a first section having a first groove with a right-hand helical profile, a second section having a second groove with a left-hand helical profile, and a first central section having a first curved transition connecting the first and second groove. A male rotor rotatably positioned in the first portion of the compression chamber, the male rotor including a third section having a first lobe with a right-hand helical profile, a fourth section having a second lobe with a left-hand helical profile, and a second central section having a second curved transition connecting the first and second lobes.

BRIEF DESCRIPTION OF THE DRAWINGS

The aspects and features of various exemplary embodiments will be more apparent from the description of those exemplary embodiments taken with reference to the accompanying drawings, in which.

DETAILED DESCRIPTION OF EXEMPLARY EMBODIMENTS

Figure 1:
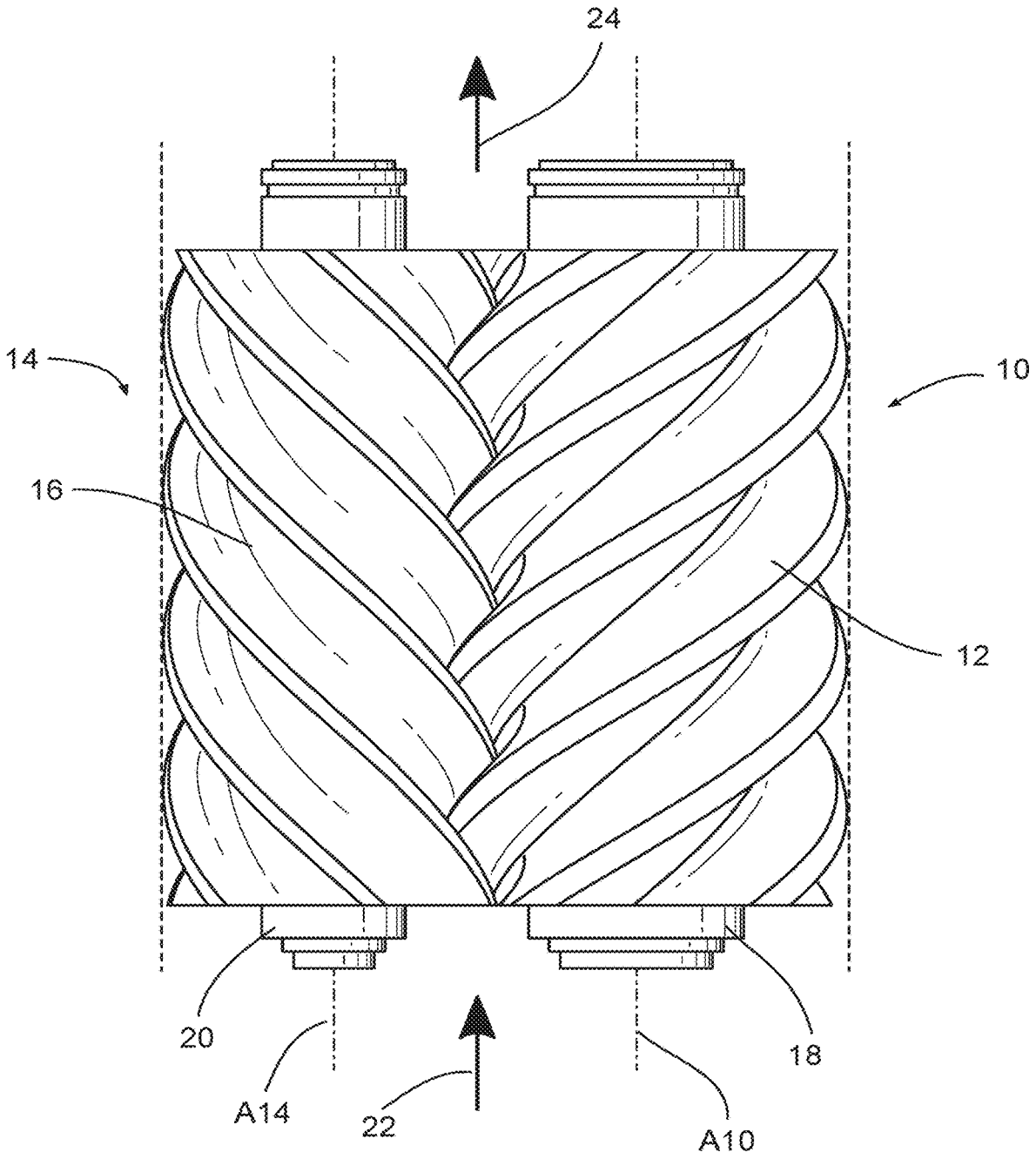
FIG. 1 is a top view of traditional set of rotors for a screw compressor.

FIG. 1 shows an exemplary embodiment of a typical compressor design that includes a male rotor 10 having one or more lobes 12 and a female rotor 14 having one or more grooves or gates 16. The male rotor 10 is mounted on a first shaft 18 and the female rotor 14 is mounted on a second shaft 20. The male rotor 10 is positioned in a first section of a chamber and the female rotor 14 is positioned in a second section of the chamber. Fluid enters the chamber at an inlet 22, and when the rotors are driven, the lobes 12 of the male rotor 10 fit into the grooves 16 of the female rotor 14, causing compression and movement of the fluid towards an outlet or discharge end 24 where the compressed fluid is discharged. The male and female rotors 10, 14 have a constant lead or pitch extending along the length of the rotor, a constant profile, and a constant outer diameter. Accordingly the chamber is defined by a pair of intersecting cylinders that have parallel longitudinal axes.

Figure 2:
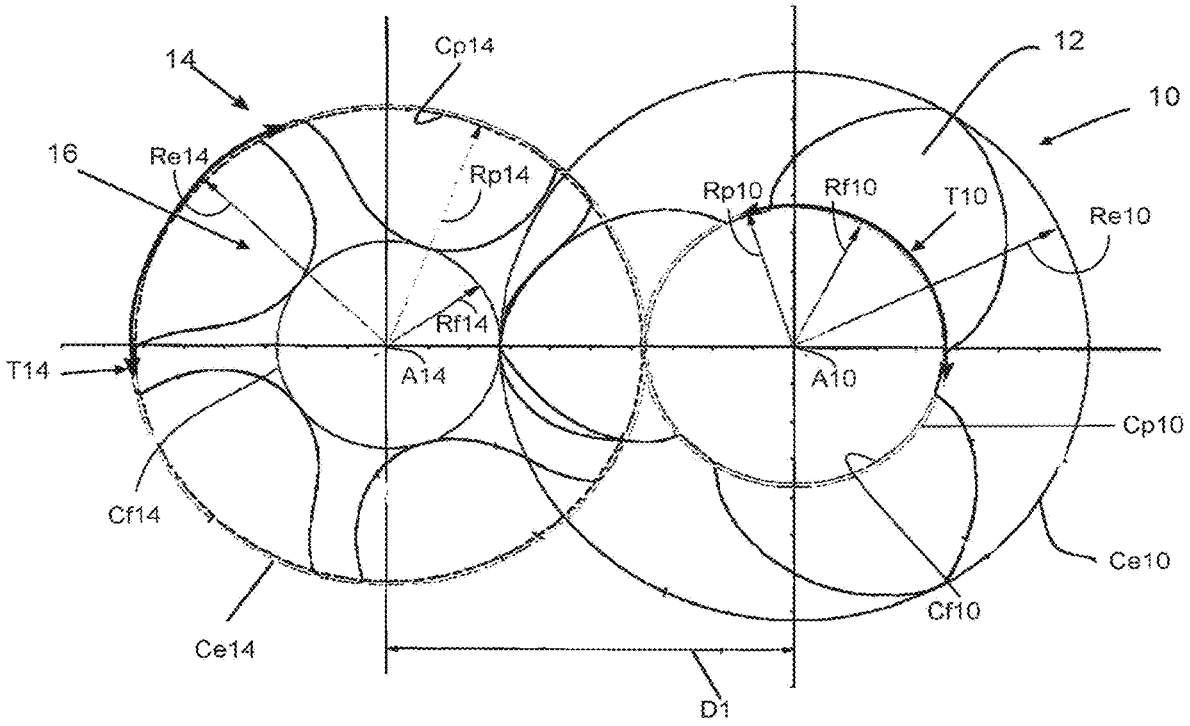
FIG. 2 is a cross sectional view of the rotors of FIG. 1.

As best shown in FIG. 2, the male rotor 10 rotates around a first axis A10 of rotation whereas the female rotor 14 rotates around a second axis A14 of rotation. In particular, the first axis A10 is located at a distance D1 (commonly known by the term "center distance") from the second axis A14 of rotation. The first axis A10 and second axis A14 are mutually parallel, so that D1 is constant over the axial length of the rotor.

The male rotor 10 includes a pitch circumference Cp10. The radius Rp10 of the pitch circumference Cp10 is proportional to the number of lobes 12 of the male rotor 10. Each lobe 12 of the male rotor 10 extends prevalently outside the corresponding pitch circumference Cpio until reaching an outer circumference Ceio of the male rotor 10. The remaining part of the lobe 12 of the male rotor 10 extends inside the corresponding pitch circumference Cp10 until reaching a root circumference Cf10 of the male rotor 10. The radius Rf10 of the root circumference Cf10 is smaller than the radius Rp10 of the pitch circumference Cp10, which is in turn smaller than the radius Re10 of the outer circumference Ce10 of the male rotor 10. The distance between the pitch circumference Cp10 and the outer circumference Ce10 of the male rotor 10 is defined as the addendum of the male rotor 10. The male addendum corresponds to the difference between the value of the radius Re10 of the outer circumference Ce10 and the value of the radius Rp10 of the pitch circumference Cp10 of the male rotor 10. Each lobe 12 of the male rotor 10 has a first thickness Tbo measured on the respective pitch circumference Cp10 that extends from a first mid-point between two lobes to an adjacent midpoint between two lobes, or the pith circumference Cp10 divided by the number of lobes, in this case 120? of the pitch circumference Cp10.

The female rotor 14 includes a pitch circumference Cp14. The measure of the radius Rp14 of the circumference Cp14 of the female rotor 14 is proportional to the number of grooves 16 of the female rotor. Each groove 16 extends prevalently inside the corresponding pitch circumference Cp14 until reaching a root circumference Cf14 of the female rotor 14. The remaining part of the groove 16 of the female rotor 14 extends outside the corresponding pitch circumference Cp14 until reaching an outer circumference Ce14 of the female rotor 14. The radius Rf14 of the root circumference Cf14 is smaller than the radius Rp14 of the pitch circumference Cp14, which is in turn smaller than the radius Re14 of the outer circumference Ce14 of the female rotor 14. The distance between the pitch circumference Cp14 and the outer circumference Ce14 of the female rotor 14 is defined as the addendum of the female rotor 14. The female addendum corresponds to the difference between the value of the radius Re14 of the outer circumference Ce14 and the value of the radius Rp14 of the pitch circumference Cp14 of the female rotor 14. The space between each groove 16 of the female rotor 14 has a second thickness T14 measured on the respective pitch circumference Cp14 that extends from a first mid-point between two grooves to an adjacent midpoint between two grooves, or the pith circumference Cp14 divided by the number of grooves 16, in this case 72? of the pitch circumference Cp14.

Variable Profile

Figure 3:
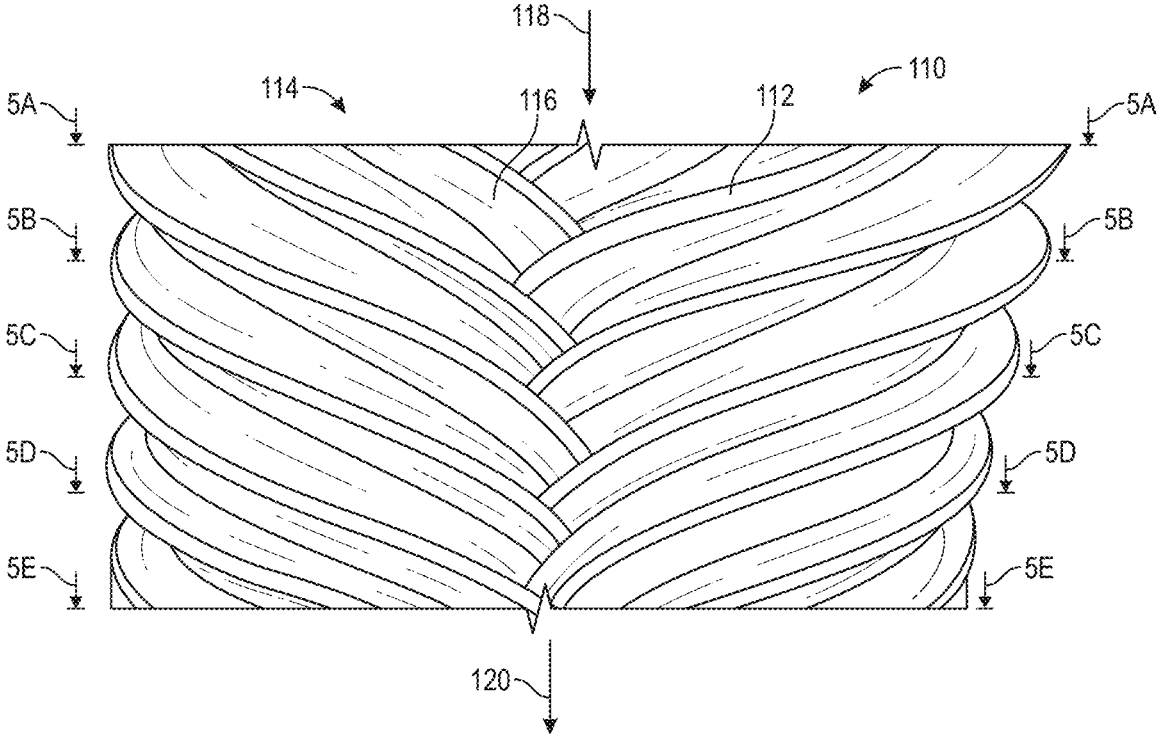
FIG. 3 is a top view of an exemplary set of variable rotors for a screw compressor.

Various exemplary embodiments are directed to a rotor combination where at least one of the rotors has a varied profile and/or outer diameter. FIG. 3 shows an exemplary embodiment of a compressor design that includes a male rotor 110 having one or more lobes 112 and a female rotor 114 having one or more grooves 116. The rotors 110, 114 have an inlet side 118 and an outlet side 120, with the rotors 110, 114 extending an axial length there between. The profile of the lobes 112 and grooves 116 varies between the inlet side 118 and the outlet side 120, as does the outer diameter of the male rotor 110 and the female rotor 112.

Figure 4:
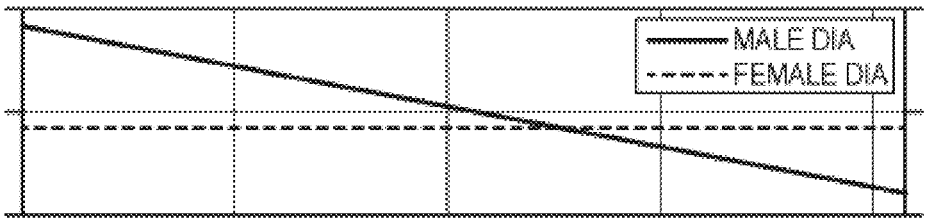
FIG. 4 is a graph representing the outer diameter of the male and female rotors of FIG. 3.
Figure 5A:
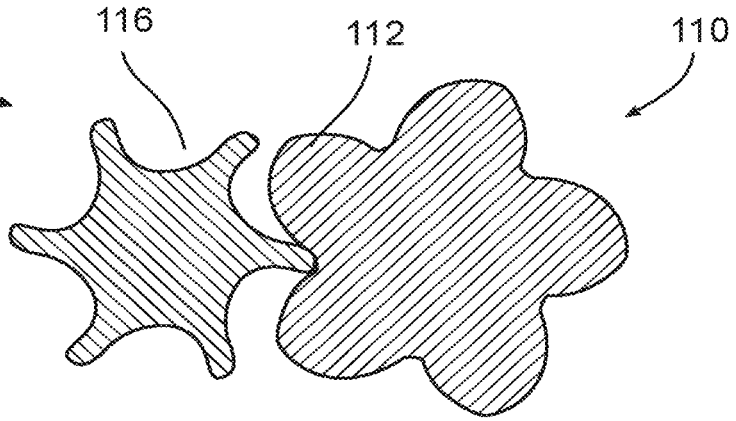
FIGS. 5A-5E are cross sectional views of the rotors of FIG. 3 taken at the positions indicated in FIG. 3.
Figure 5B:
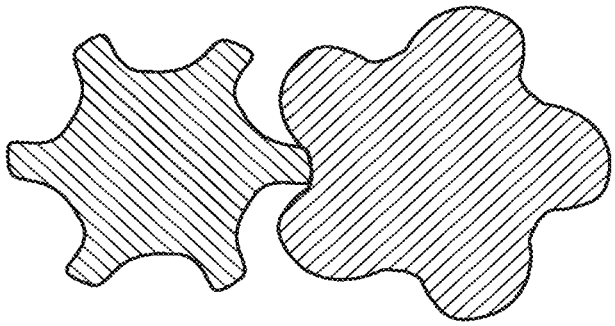
Figure 5C:
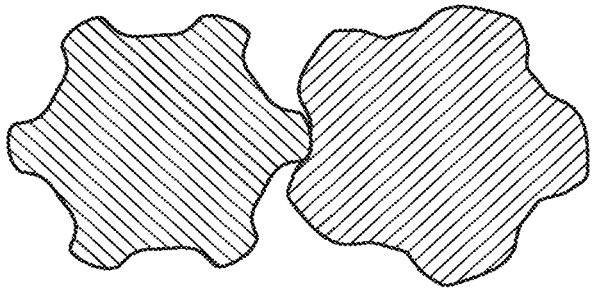
Figure 5D:
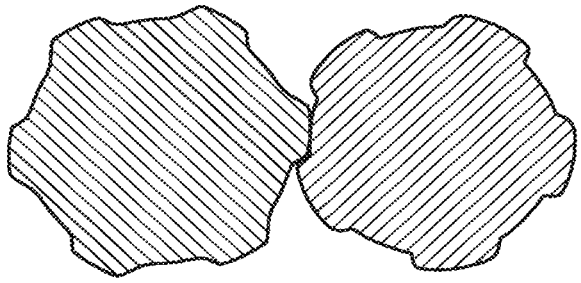
Figure 5E:
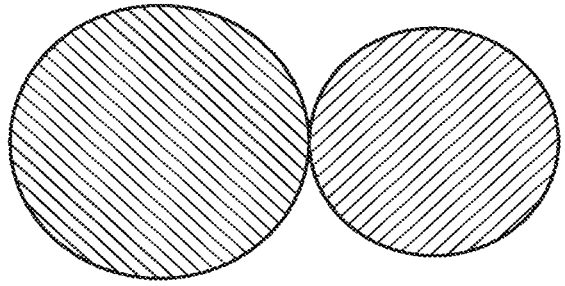

FIG. 4 shows a chart representing the outer diameter of the male rotor 110 and the female rotor 114 vs the axial position. As shown in FIG. 4, the outer diameter of the male rotor 110 and the female rotor 114 decrease in a substantially linear fashion. The outer diameter of the male and female rotor 110, 114 decreases toward the pitch diameter which remains constant, and in some embodiments the final outer diameter of both the male and female rotors 110, 114 substantially equals the respective pitch diameter. Because of this, the axis of rotation of the male and female rotors 110, 114 remains substantially parallel. Because the male has a larger beginning addendum, the outer diameter of the male rotor 110 will decrease more proportional to the outer diameter of the female rotor 114. Moreover, the male rotor portion and the female rotor portion of the compression chamber will have a diameter that decreases in conjunction with the outer diameter of the rotors 110, 114. This results in rotors 110. 114 and the respective compressor chamber portions having a substantially frusto-conical configuration.

FIGS. 5A-5E shows the change in profile of the male rotor 110 and the female rotor 114 from the inlet side 118 to the outlet side 120, respectively. As shown, the male and female rotors 110, 114 transition from a form resembling a more traditional lobe and groove profile to a substantially cylindrical profile. The male and female addendum decrease with the value of the outer radii moving toward the respective pitch radii. In certain exemplary embodiment, the male outer radius can substantially equal the male pitch radius and the female outer radius can substantially equal the female pitch radius at the outlet side 120, resulting in an addendum of approximately zero. The tip width and the root diameter of the male and female rotor 110, 114 increase toward the outlet side 120.

Figure 6:
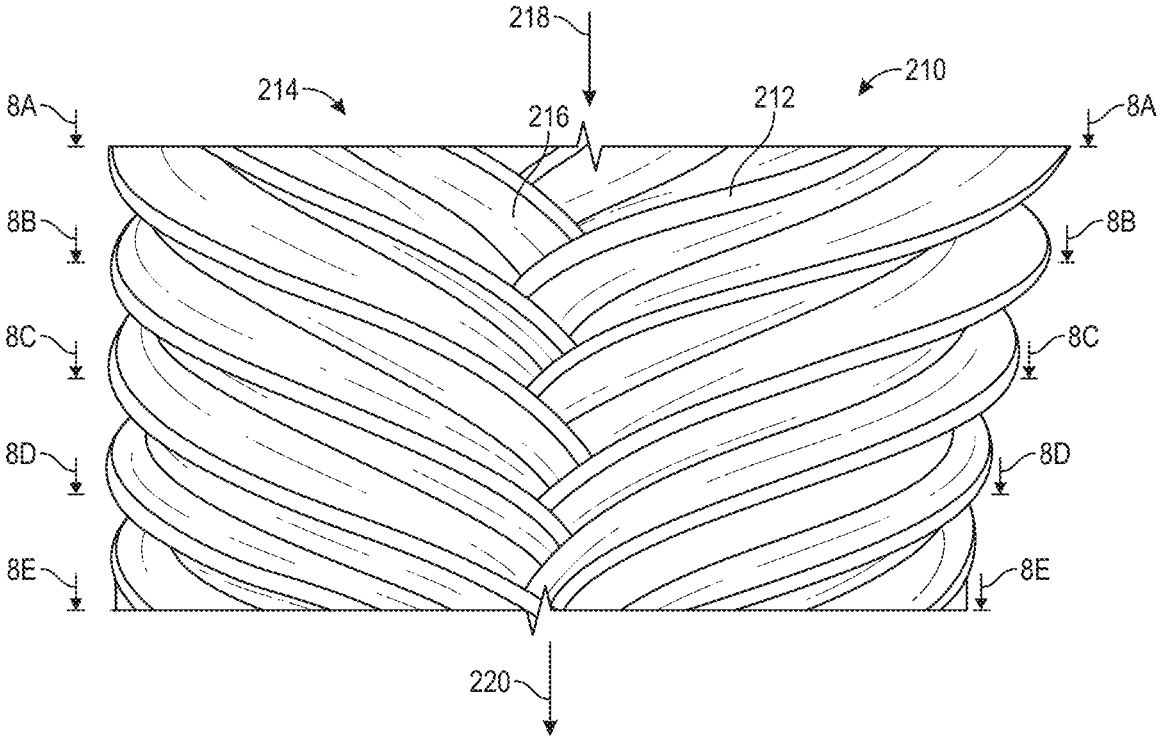
FIG. 6 is a top view of another exemplary set of variable rotors for a screw compressor.

FIG. 6 shows an exemplary embodiment of a compressor design that includes a male rotor 210 having one or more lobes 212 and a female rotor 214 having one or more grooves 216. The rotors 210, 214 have an inlet side 218 and an outlet side 220, with the rotors 210, 214 extending an axial length therebetween. The profile of the lobes 212 and grooves 216 varies between the inlet side 218 and the outlet side 220. The profile of the lobes 212 and grooves 216 varies between the inlet side 218 and the outlet side 220, as does the outer diameter of the male rotor 210 and the female rotor 212.

Figure 7:
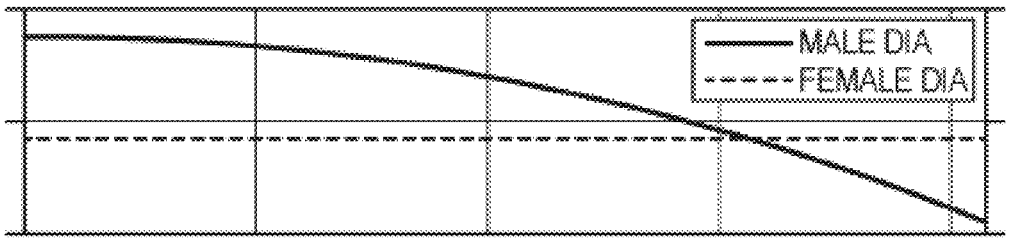
FIG. 7 is a graph representing the outer diameter of the male and female rotors of FIG. 6.
Figure 8A:
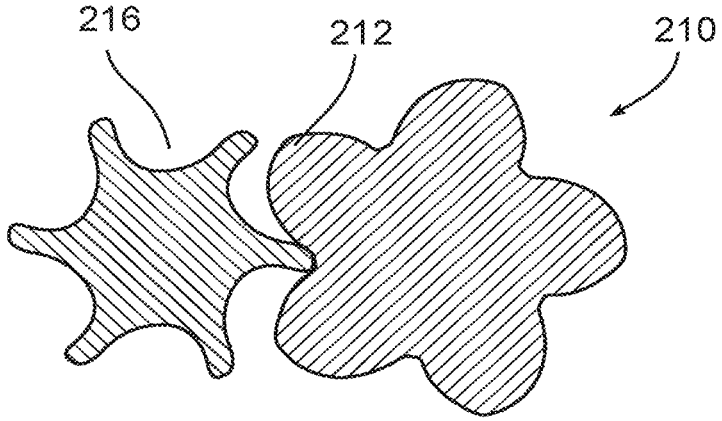
FIGS. 8A-8E are cross sectional views of the rotors of FIG. 6 taken at the positions indicated in FIG. 6.
Figure 8B:
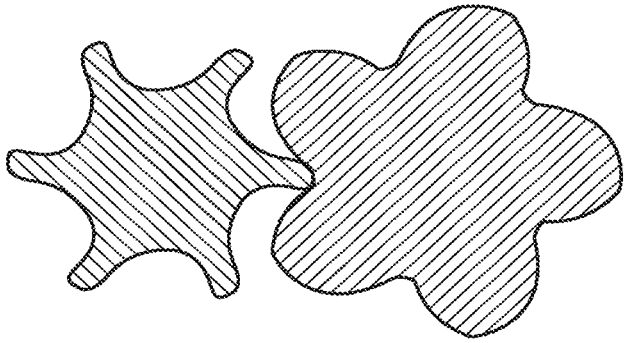
Figure 8C:
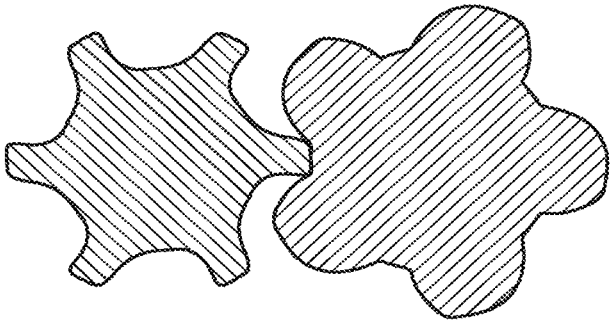
Figure 8D:
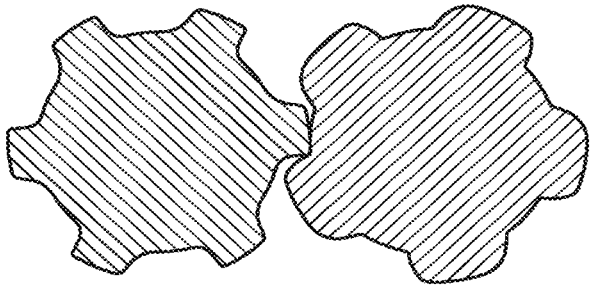
Figure 8E:
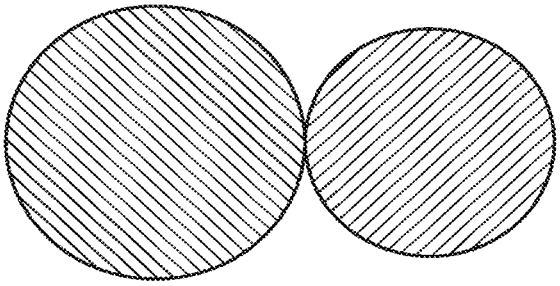

FIG. 7 shows a chart representing the outer diameter of the male rotor 210 and the female rotor 214 vs the axial position. As shown in FIG. 7, the outer diameter of the male rotor 210 and the female rotor 214 decrease in a non-linear fashion. As shown in this example, the outer diameter holds substantially constant for a first portion and then decreases at a rate that forms a curved portion that has an arc. Similar to the male and female rotors 110, 114 in FIG. 3, the outer diameter of the male and female rotor 110, 114 decreases toward the respective pitch diameter, allowing the axis of rotation of the male and female rotors 210, 214 to remain substantially parallel. Moreover, the male rotor portion and the female rotor portion of the compression chamber will have a diameter that decreases in conjunction with the outer diameter of the rotors 110, 114. This results in rotors 110. 114 and the respective compressor chamber portions having a substantially frusto-ogive configuration.

FIGS. 8A-8E shows the change in profile of the male rotor 210 and the female rotor 214 from the inlet side 218 to the outlet side 220, respectively. As shown, the male and female rotors 210, 214 transition from a form resembling a more traditional lobe and groove profile to a substantially cylindrical profile. The male and female addendum decrease with the value of the outer radii moving toward the respective pitch radii. In certain exemplary embodiment, the male outer radius can substantially equal the male pitch radius and the female outer radius can substantially equal the female pitch radius at the outlet side 220, resulting in an addendum of approximately zero. The tip width and the root diameter of the male and female rotor 210, 214 increase toward the outlet side 220.

When comparing FIGS. 5A-5E and FIGS. 8A-8E, it is shown that the transition steps are substantially constant for the rotor sections shown in FIGS. 5A-5E, while the transition is much more significant toward the outlet side of the rotors in FIGS. 8A-8E.

Figure 9:
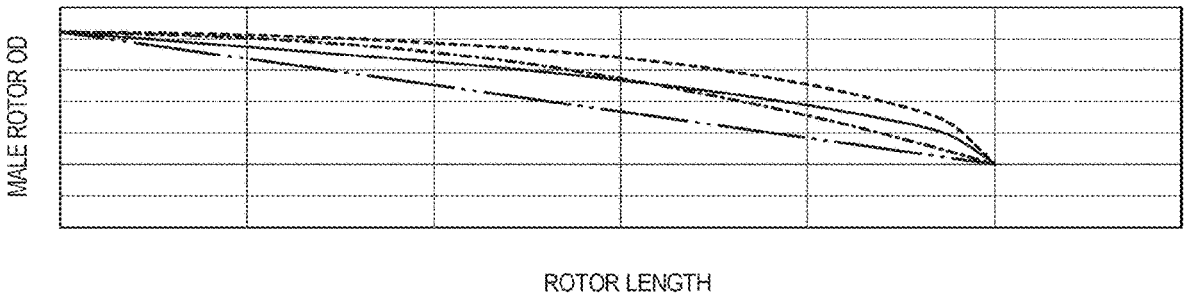
FIG. 9 is a chart showing a set of curves representing different embodiments of variable male rotors.

The rotors no, 114 shown in FIG. 3 are just one example of a linear transition and the rotors 210, 214 shown in FIG. 6 are just one example of a curved transition in the outer diameter of the male rotor. FIG. 9 shows different curves of the male rotor outer diameter vs the rotor length. The curves include various portions having a fast transition (larger or more pronounced) or a slow transition (smaller or less pronounced). Other changes in the outer diameter of the male and female rotors can be used, including various linear and curved combinations, and more complex curves have a non-constant arch or different sections with different radii of curvature.

The variable profile can result in lower radial leakage and short sealing lines in a compressor. In certain embodiments, the profile can be varied to eliminate the blow hole on the discharge end. A compressor can also be created with little or no discharge end clearance and no trap pocket. The varied profile can also result in a large discharge port. Some exemplary advantages of using the variable profile configuration can include faster compression, lower leakage, and higher performance. The variable profile configuration can also result in higher efficiency, higher speeds, decreased port losses at maximum speeds, and higher internal pressure ratios from a single stage.

Figure 10:
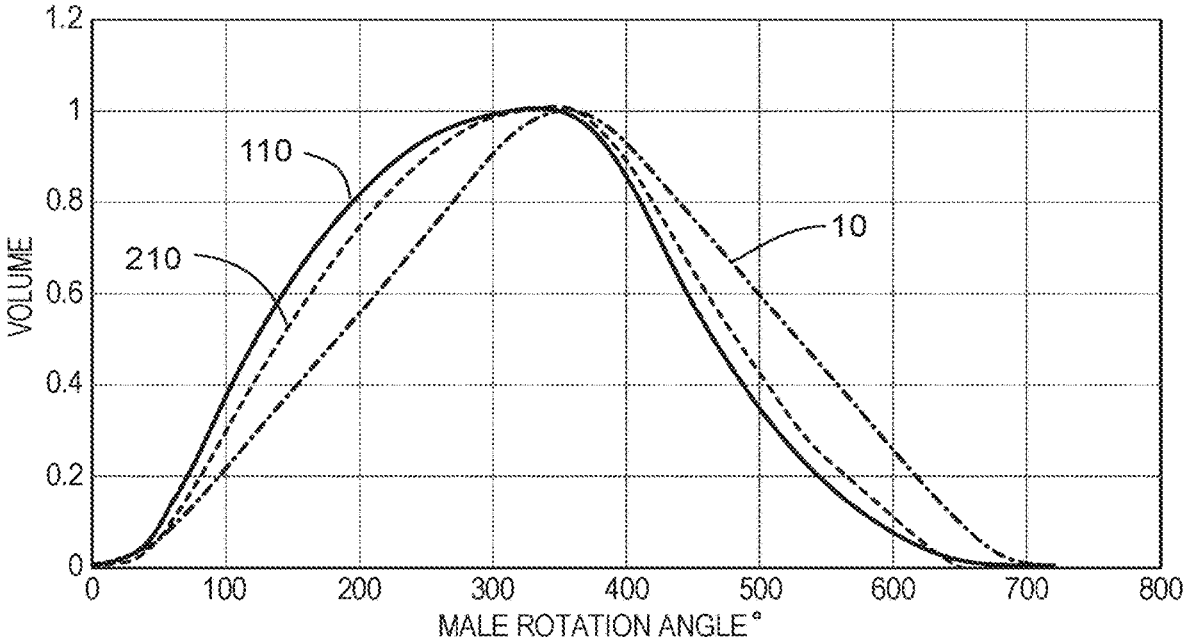
FIG. 10 is a chart showing volume vs male rotation angle for the male rotors of FIGS. 1, 3, and 6.
Figure 11:
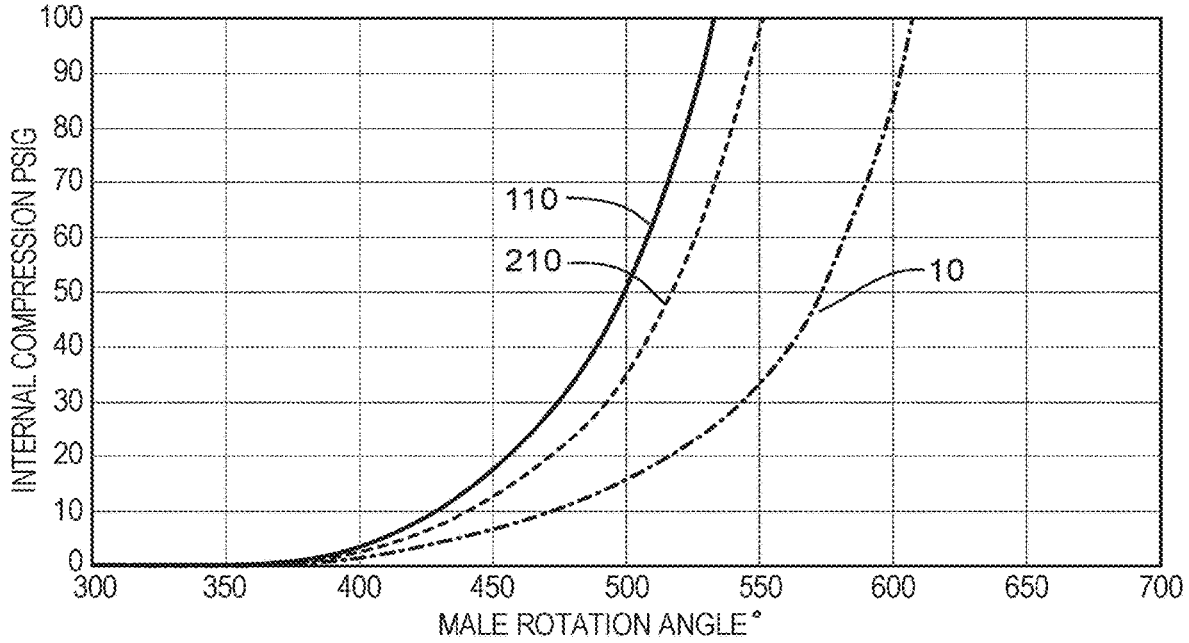
FIG. 11 is a chart showing compression vs male rotation angle for the male rotors of FIGS. 1, 3, and 6.

FIG. 10 shows the volume of the fluid vs the rotation angle of the male rotors 10, 110, 210. The inlet volume increases faster for the variable profile rotors 110, 210 and reduces faster once the inlet is closed at the maximum volume and the fluid begins to compress. FIG. ii shows the internal compression vs the rotation angle of the male rotors 10, 110, 210. The compression rate for the variable profile rotors 110, 210 is greater than the traditional rotor 10 at any given rotation angle.

Rack Scaling

Various exemplary embodiments are directed to designing and creating a rotor with a variable profile. In one exemplary method, a rack curve is created that is used to create the male lobes and female grooves for a given rotor section. A rack is substantially equal to the lobe thickness T10 and groove thickness T14 shown in FIG. 2. A first rack is created that can define the lobes and grooves at a first section. In an exemplary embodiment, the first section can be the very beginning or inlet end of the rotors. One or more additional racks are then created to correspond to different section along the rotors axial length. The racks are created to have different curves, for example with different crests. The profile of the rotors can then be created based on this set of racks. The sections between the racks can be determined using different methods, including linear interpolation or different curve fitting techniques.

Figure 12:
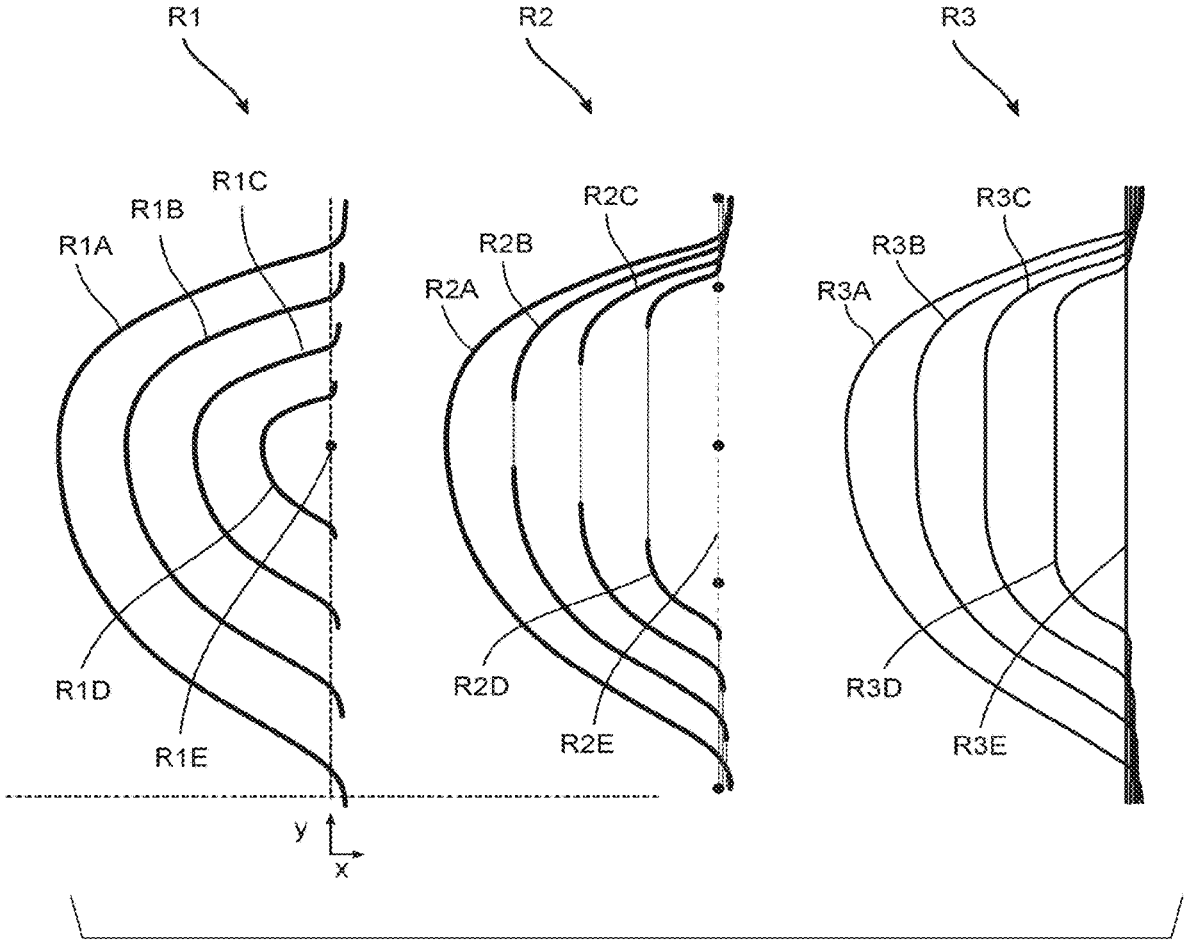
FIG. 12 is three sets of rack curves used to create a variable profile rotor.
Figure 13:
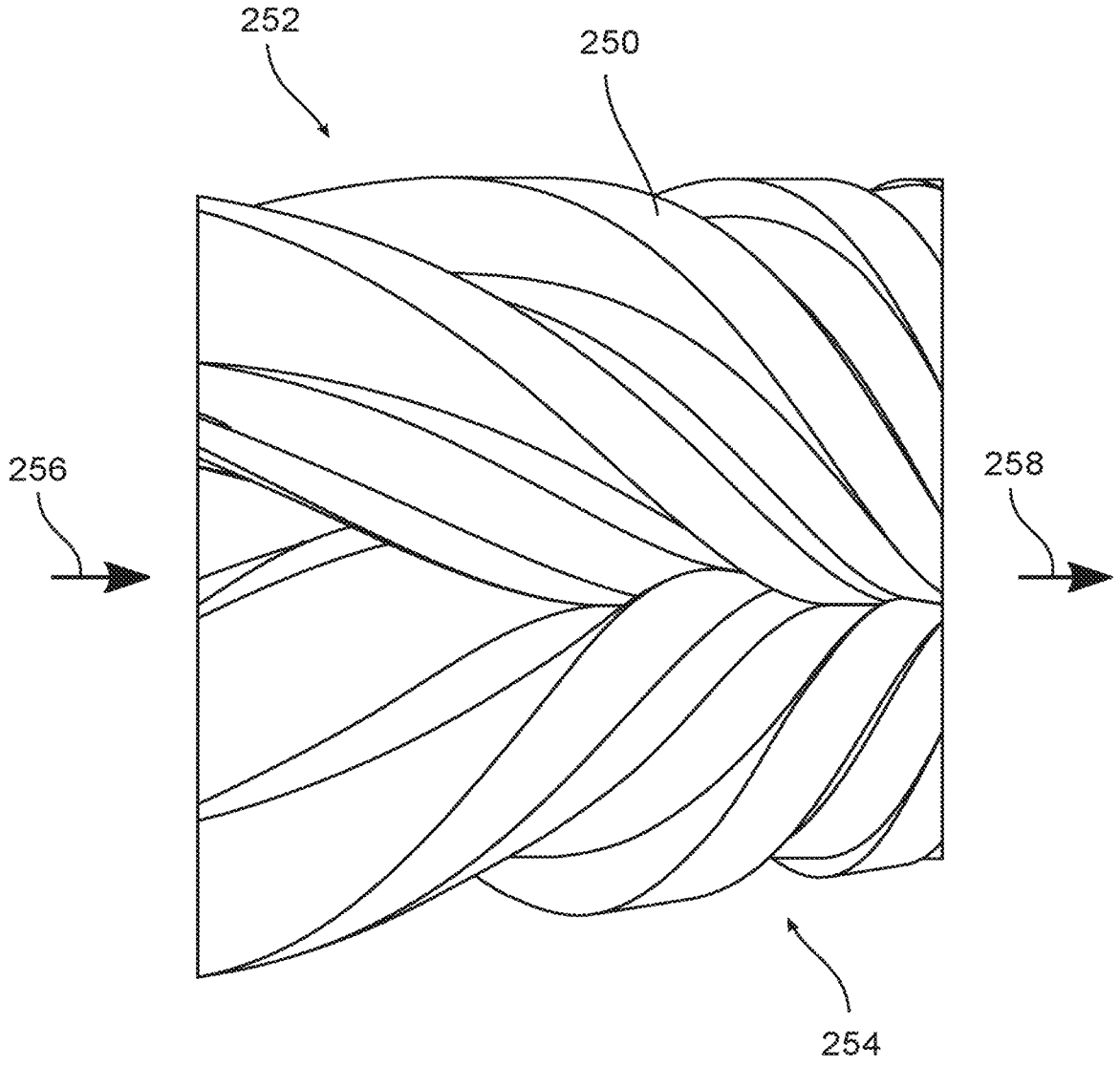
FIG. 13 is set of variable profile rotors showing the tip widening do to the rack scaling in the X and Y direction.

One exemplary embodiment includes creating a variable profile rotor by scaling the X and Y coordinates of a rack. FIG. 12 shows a series of rack curves R1, R2, and R3. A rack is substantially equal to the lobe thickness T10 and groove thickness T14 show in FIG. 2. An initial rack curve R1A is determined based on the operating characteristics of a compressor, having a top endpoint and a bottom endpoint. In an exemplary embodiment, the remaining rack curves R1B, R1C, R1D, R1E are then scaled in the X and Y directions down to a certain level, for example down to the single point R1E which represents a completely vertical rack line, and therefore a cylindrical surface. Scaling in the X and Y direction results in a decreased height in the Y direction, which moves the top and bottom endpoint of each intermediate curve R1B-R1D in towards the final point R1E. In certain embodiments, it is necessary to maintain the original rack height to maintain a constant ditch diameter down the rotor length. As shown in the second set of rack curves R2, the non-initial rack curves R2B-R2E are separated at a certain point and spaced apart forming open sections between a first and second inner point as shown in the thinner line segments of the intermediate second rack curves R2B-R2D. The curves can be separated at a crest or peak of the respective curve in the X direction. The first and second inner points can then be connected and the top and bottom end points can be extended to the original top and bottom Y values as shown in the third set of rack curves R3. As best shown in FIG. 13, when the rack curves are spaced to maintain a consistent Y height, the male rotor tips 250 are widened as the male rotor 252 and the female rotor 254 travel from the inlet side 256 to the outlet side 258. This can help reduce the tip leakage rate of the compressor. The amount of scaling and the amount of steps chosen can be varied to create different types and amount of transitions as discussed above. Although this process describes choosing an initial rack curve R1 that is toward an inlet side, the initial rack curve can be selected at any point, and then scaled up or down appropriately.

In certain embodiments, only discrete points along the rack curve will be known, and different methods of interpolation and/or curve fitting can be used to determine the connections between these points. For example, linear interpolation, polynomial interpolation, and spline interpolation can be used to determine the rack curves.

Figure 14:
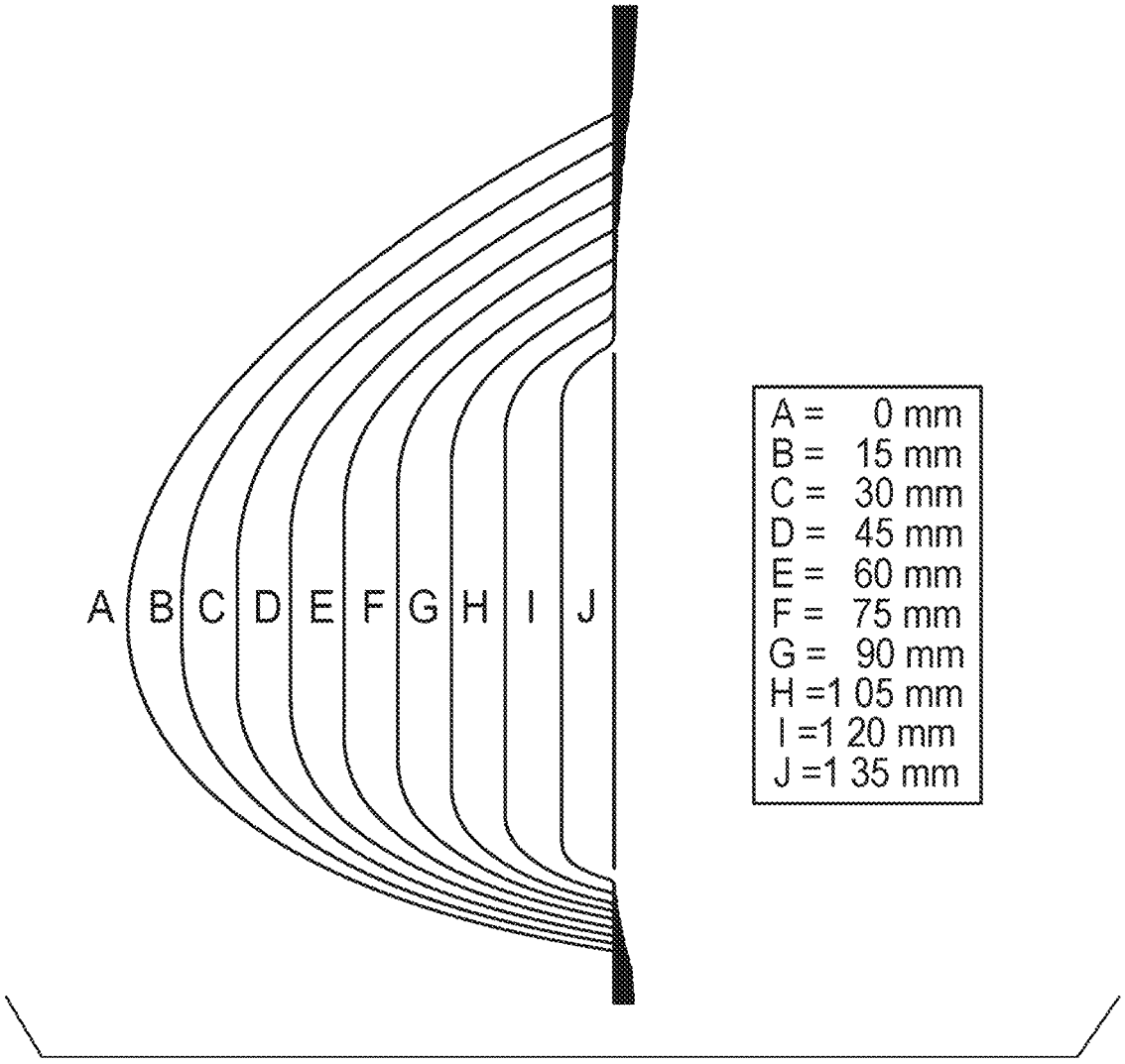
FIG. 14 shows a set of rack curves created through scaling a rack in the X and Y direction.
Figure 15:
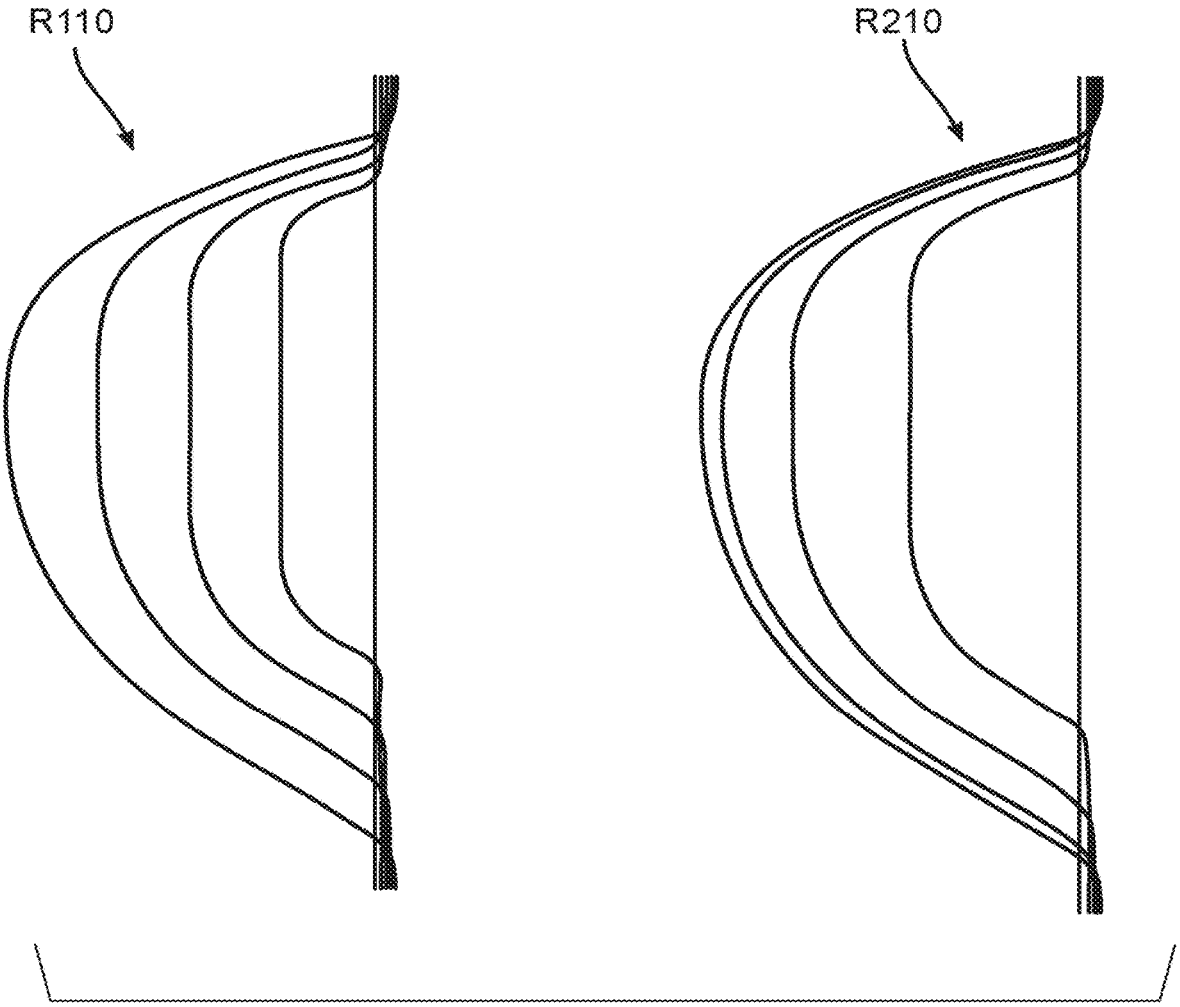
FIG. 15 shows a s set rack curves used to create a linearly variable rotor and a set of rack curves used to create a non-linearly variable rotor.

FIG. 14 shows an exemplary series of scaled rack curves A-J and their position along the axial length of a rotor. FIG. 15 shows the set of rack curves R110 that are linearly variable, for example used to create a male rotor having a substantially conical configuration similar to the rotor no shown in FIG. 3 and a set of rack curves R210 that are non linearly variable, for example used to create a male rotor having a substantially ogive configuration similar to the rotor 210 shown in FIG. 6. As can be seen in FIG. 15, the first set of curves R110 has substantially even scaling, while the second set of curves R210 has varied scaling, with the initial curves scaled by smaller amounts and the later curves scaled by larger amounts.

Variable Helix

Other exemplary embodiments are directed to set of rotors having a variable helix. FIG. 1 shows an exemplary embodiment of a compressor design that includes a male rotor 10 having one or more lobes 12 and a female rotor 14 having one or more grooves or gates 16. The male rotor 10 is mounted on a first shaft 18 and the female rotor 14 is mounted on a second shaft 20. Fluid enters at an inlet portion 22, and when the rotors are driven, the lobes 12 of the male rotor 10 fit into the grooves 16 of the female rotor 14, causing compression and movement of the fluid towards an outlet or discharge portion 24 where the compressed fluid is discharged. The male and female rotors 10, 14 have a constant lead or pitch extending along the length of the rotor.

Figure 16:
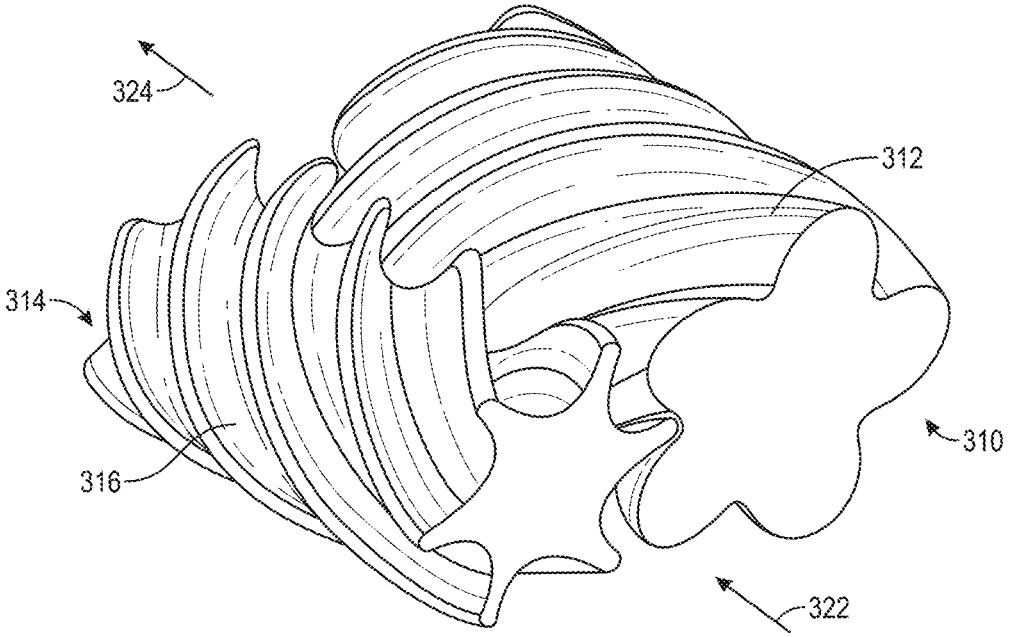
FIG. 16 is a perspective view of a continuously variable male and female rotor.
Figure 17:
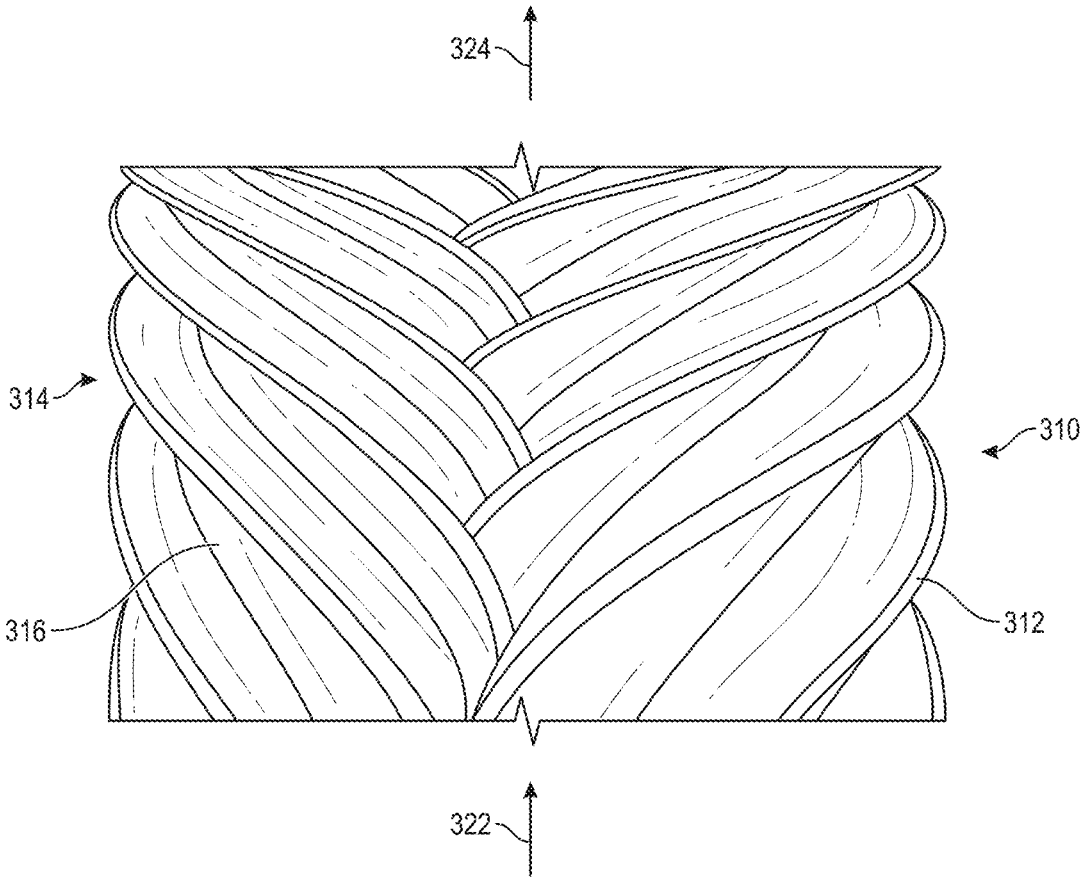
FIG. 17 is a top view of FIG. 16.

FIGS. 16 and 17 show an exemplary embodiment of a male rotor 310 and a female rotor 314 having a helical profile that has a continuously variable lead, meaning that the helical lead varies at a substantially constant rate. The male rotor 310 includes a plurality of lobes 312. The female rotor 314 includes a plurality of grooves 316. The rotation of the lobes 312 and grooves 316 increases at a substantially continuous rate from the inlet portion 322 to the outlet portion 324, allowing the rotors 310, 314 to mesh more at the outlet portion 324.

Figure 18:
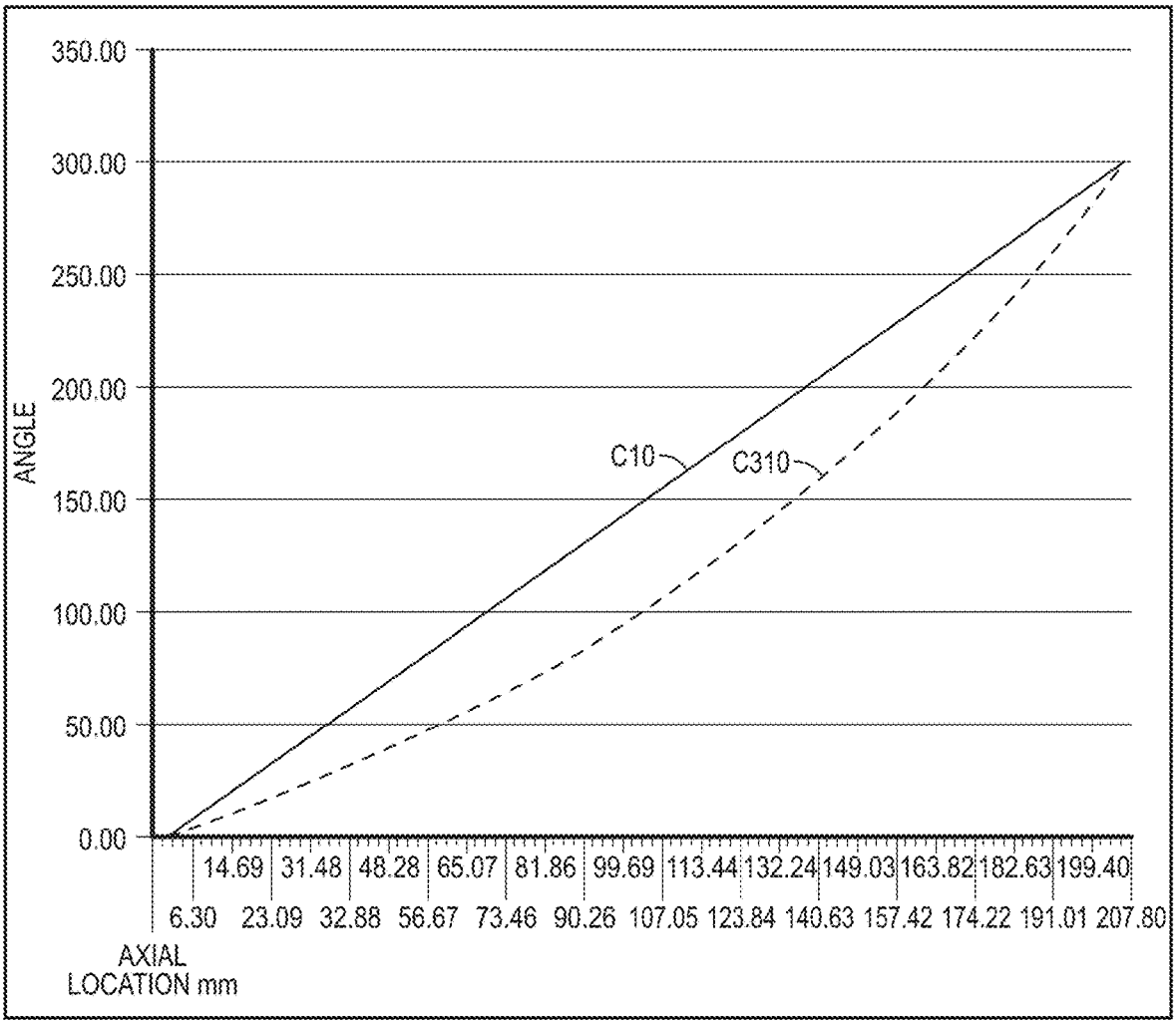
FIG. 18 is a graph showing the wrap-angle curve of the male rotors of FIG. 16 and FIG. 17.

FIG. 18 shows a graph of the wrap angle curve—profile rotation vs axial location—of the male constant helical rotor C10 and the wrap angle curve of the male continuously variable helical rotors C310. As shown, the warp angle curve C10 for the constant lead is a line having a substantially constant slope. With the continuously variable helical profile, the wrap angle curve C310 forms a concave curve where the tangent line of the points on the curve has a slope that slowly increases at a constant rate, that is the increase in the change in the slope occurs at a substantially constant rate along the length of the rotor. The change in the slope for theses rotors 310, 314 is always positive as the wrap angle curve moves from the inlet portion to the outlet portion. The female rotor curves will have different values, but follow similar trends.

Figure 19:
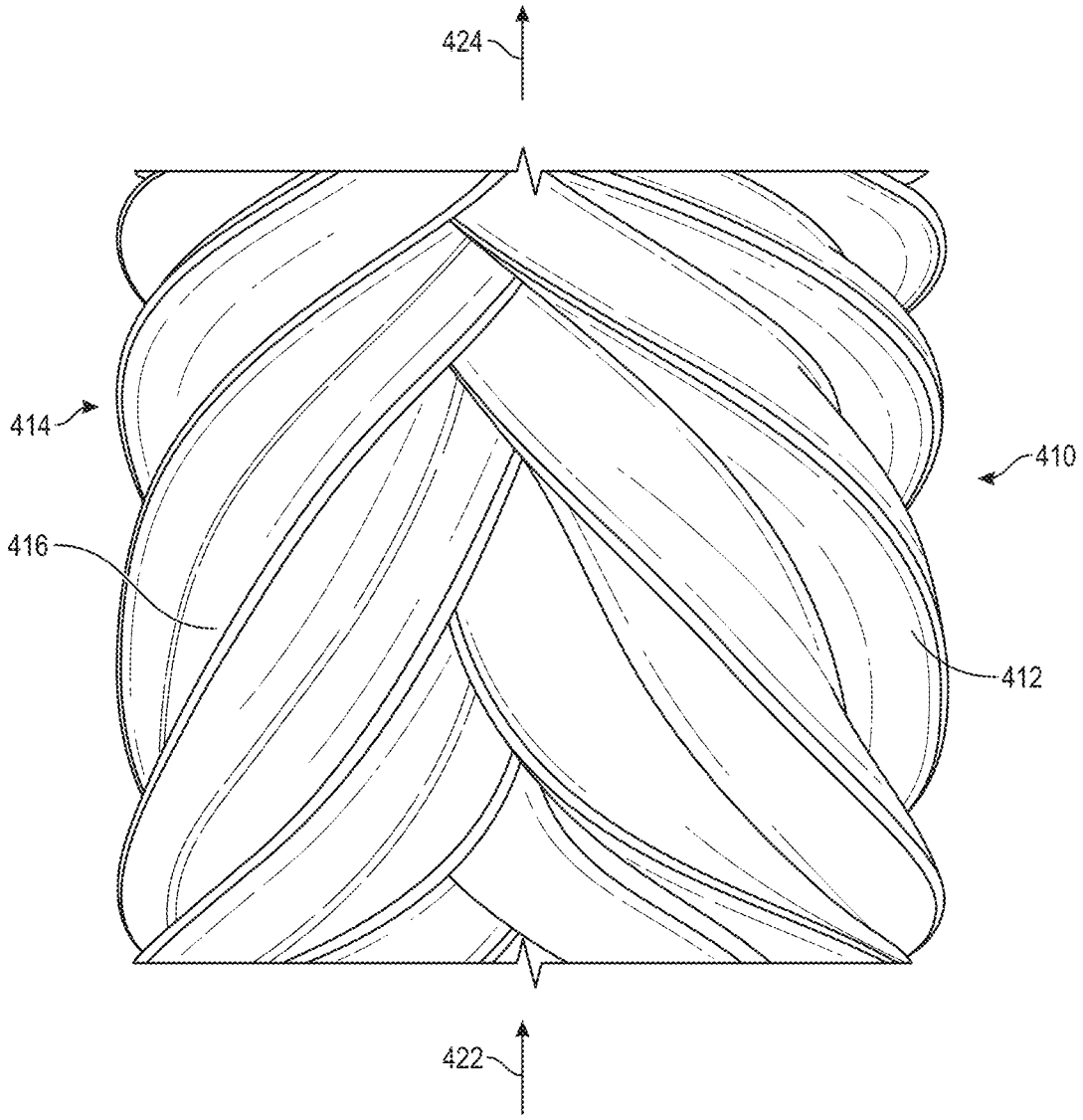
FIG. 19 is top view of a Fast Slow Fast helix male and female rotor.

FIG. 19 shows an exemplary embodiment of a male rotor 410 and a female rotor 414 having a helical profile that has a non-continuously variable lead, meaning that the helical lead varies at different rates over the length of the rotors. The male rotor 410 includes a plurality of lobes 412 and the female rotor 414 includes a plurality of grooves 416. In this exemplary embodiment, the spacing of the lobes 412 and grooves 416 changes at a Fast-Slow-Fast (FSF) rate from the inlet portion 422 to the outlet portion 424, meaning that the rate of change is less in the interior portion of the rotors 410, 414 than toward the inlet and discharge ends.

Figure 20:
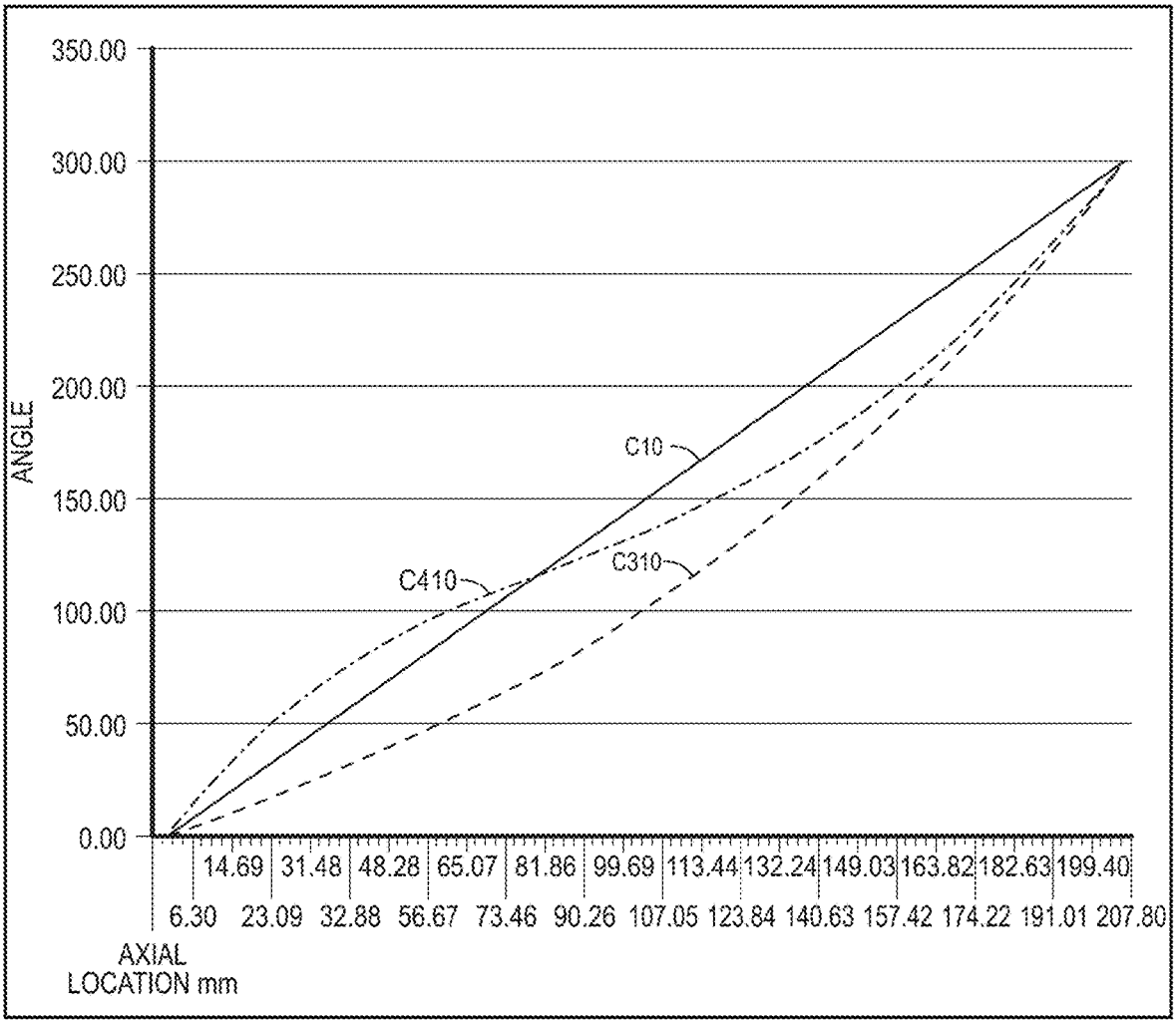
FIG. 20 is a graph showing the wrap-angle curve of the male rotors of FIG. 1, FIG. 16, and FIG. 19.

FIG. 20 shows a graph of the wrap angle of the male constant helical rotor Cm, the wrap angle curve of the male continuously variable helical rotors C310, and the wrap angle curve of the FSF male non-continuously variable helical rotor C410. As shown the FSF curve C410 includes an initial convex portion that transitions to a concave portion. Accordingly, the change in the slope is initially negative and then transitions to a positive change in the slope. As discussed above, the change in slope toward the beginning and end for the FSF curve C410 is greater than the middle portion.

Figure 21:
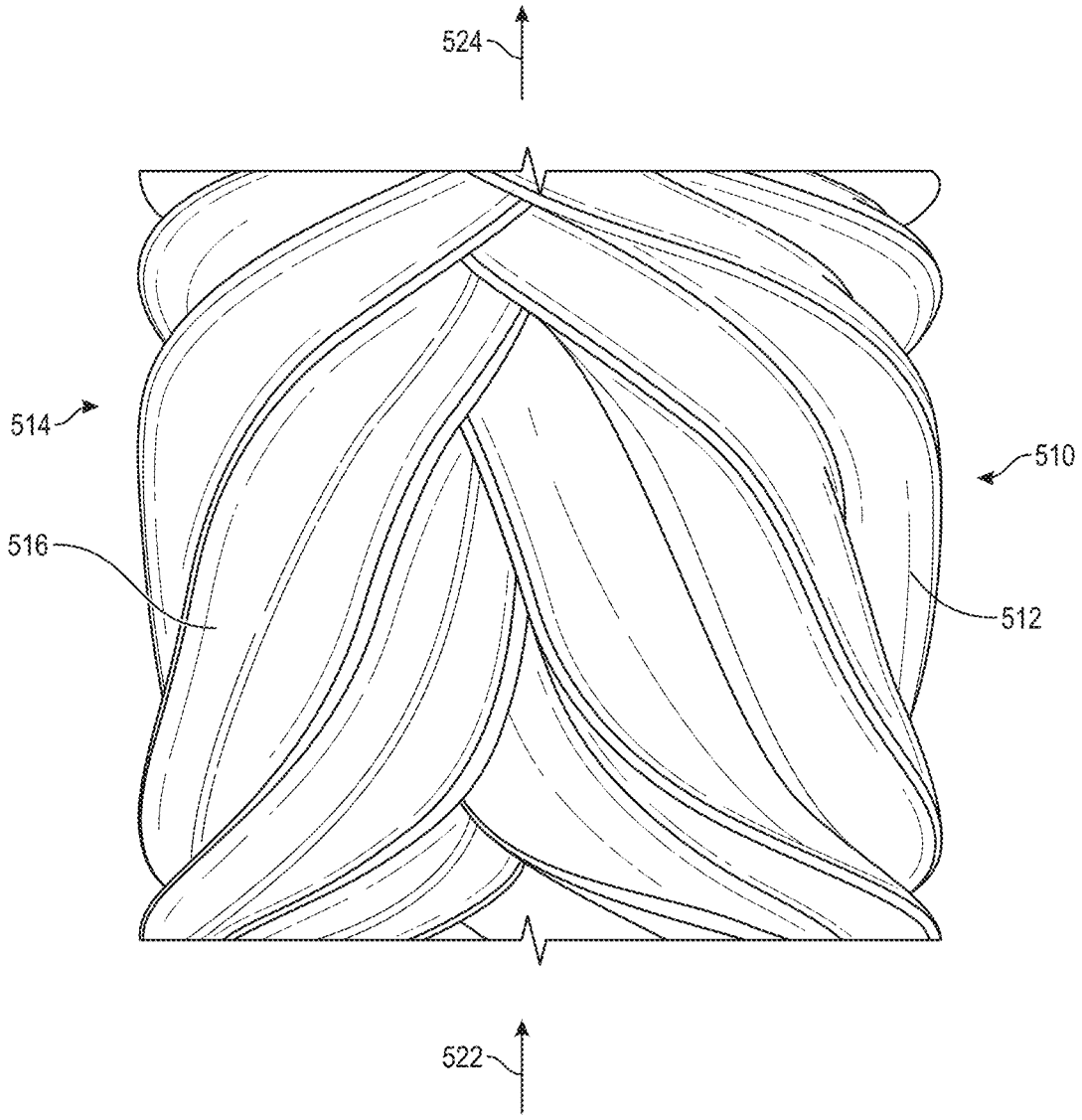
FIG. 21 is top view of a Faster Slower Faster helix male and female rotor.

FIG. 21 shows another exemplary embodiment of a male rotor 510 and a female rotor 514 having a helical profile that has a non-continuously variable lead, meaning that the helical lead varies at different rates over the length of the rotors. The male rotor 510 includes a plurality of lobes 512 and the female rotor 514 includes a plurality of grooves 516. In this exemplary embodiment, the spacing of the lobes 512 and grooves 516 changes at a Faster-Slower-Faster (FrSrFr) rate from the inlet portion 522 to the outlet portion 524, meaning that the rate of change is less in the interior portion of the rotors 510, 514 than toward the inlet and discharge ends, and that the rate of change is faster than the FSF rotors 510, 514.

Figure 22:
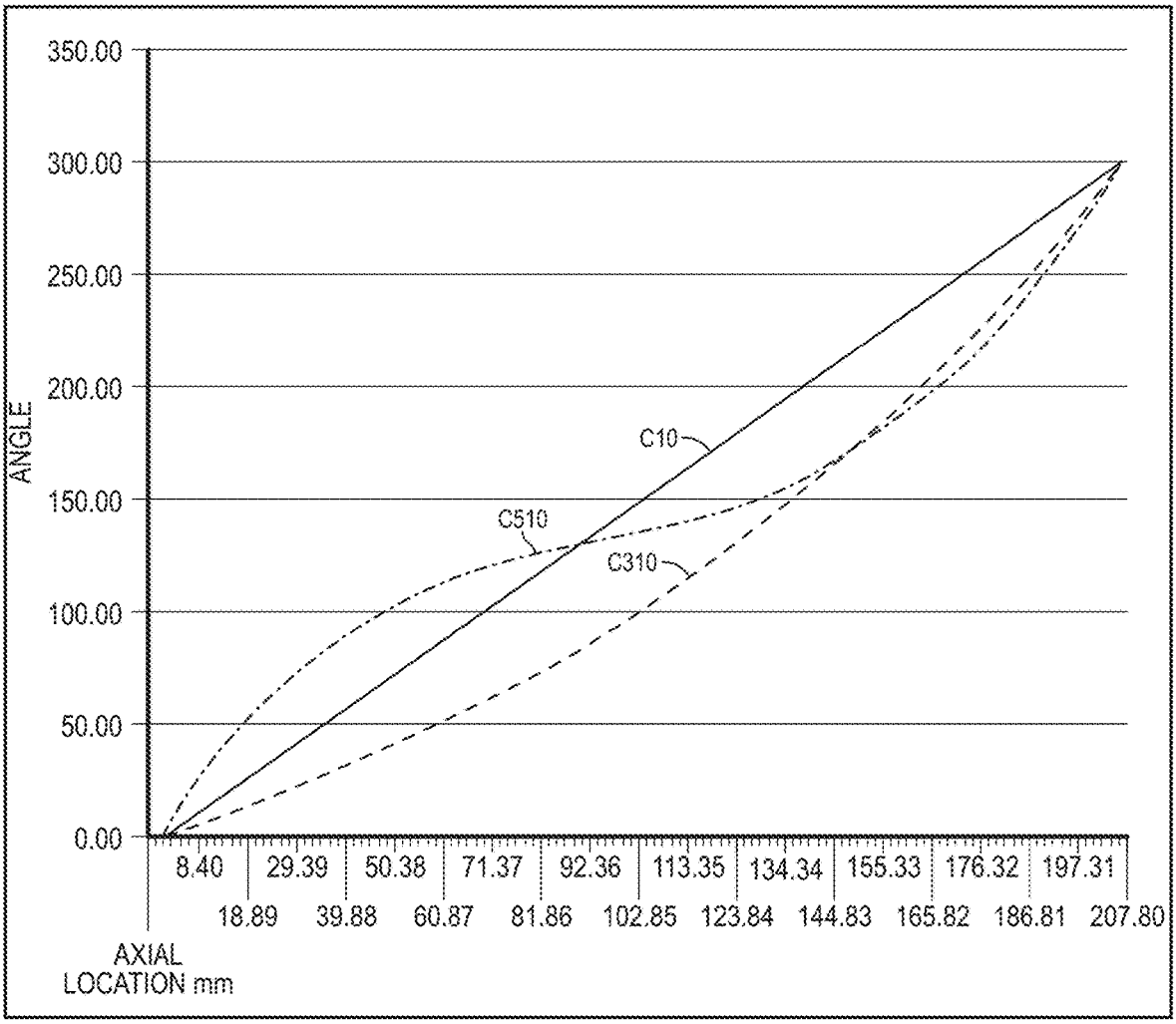
FIG. 22 is a graph showing the wrap-angle curve of the male rotors of FIG. 1, FIG. 16, and FIG. 21.

FIG. 22 shows a graph of the wrap angle of the male constant helical rotor C10, the wrap angle curve of the male continuously variable helical rotors C310, and the wrap angle curve of the FrSrFr male non-continuously variable helical rotor C510. As shown the FrSrFr curve C510 includes an initial convex portion that transitions to a concave portion. Accordingly, the change in the slope is initially negative and then transitions to a positive change in the slope. As discussed above, the change in slope toward the beginning and end for the FrSrF curve C510 is greater than the middle portion.

Figure 23:
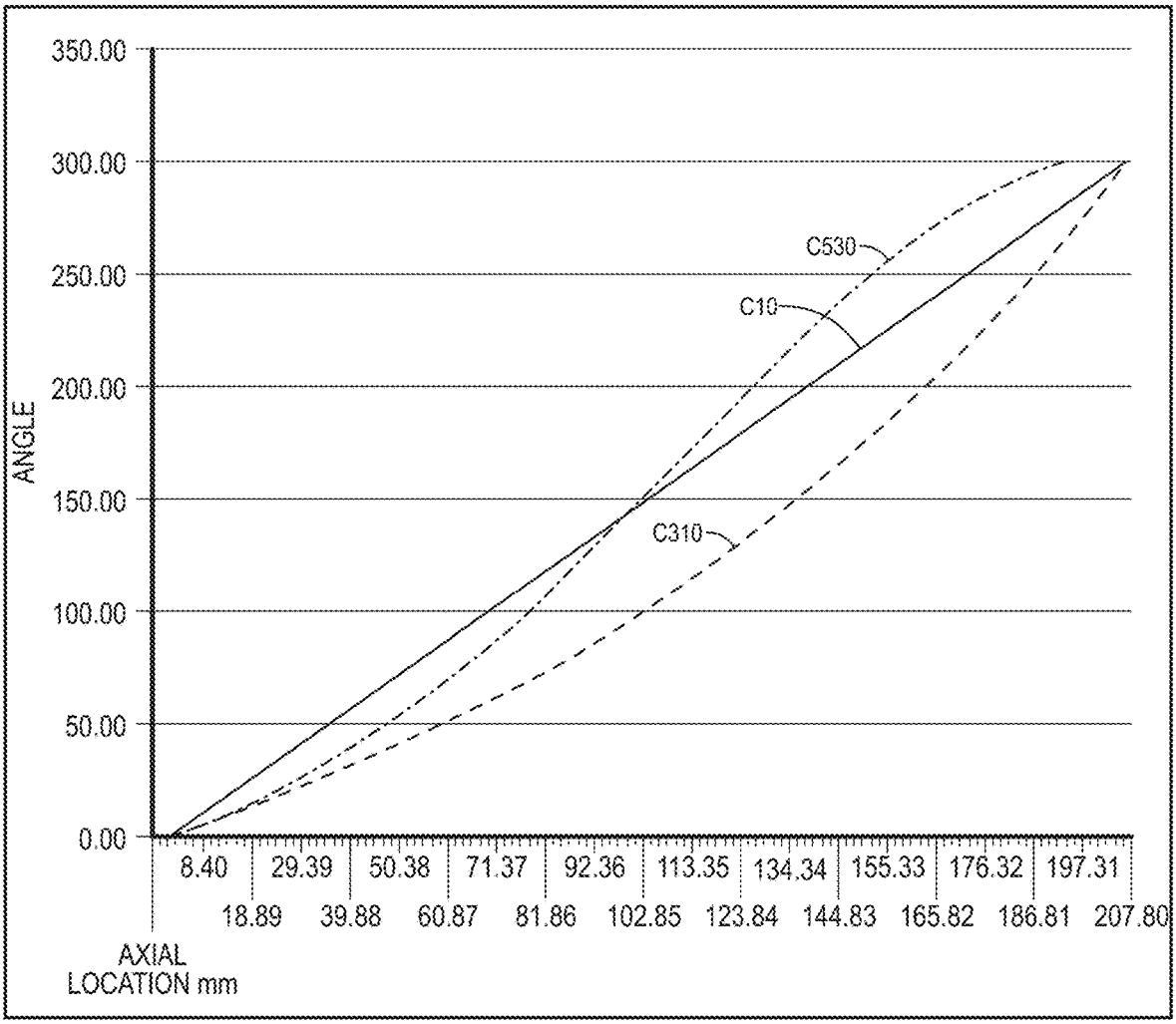
FIG. 23 is a graph showing the wrap-angle curve of the male rotors of FIG. 1, FIG. 16, and a Slow Fast Slow helix male rotor.

FIG. 23 shows a graph of the wrap angle of the male constant helical rotor C10, the wrap angle curve of the male continuously variable helical rotors C110, and the wrap angle curve of a male non-continuously variable Slow-Fast-Slow (SFS) helical rotor C530. As shown the SFS curve C530 includes an initial convex portion that transitions to a concave portion. Accordingly, the change in the slope is initially negative and then transitions to a positive change in the slope. The change in slope toward the beginning and end for the SFS curve C530 is slower than the middle portion.

Figure 24:
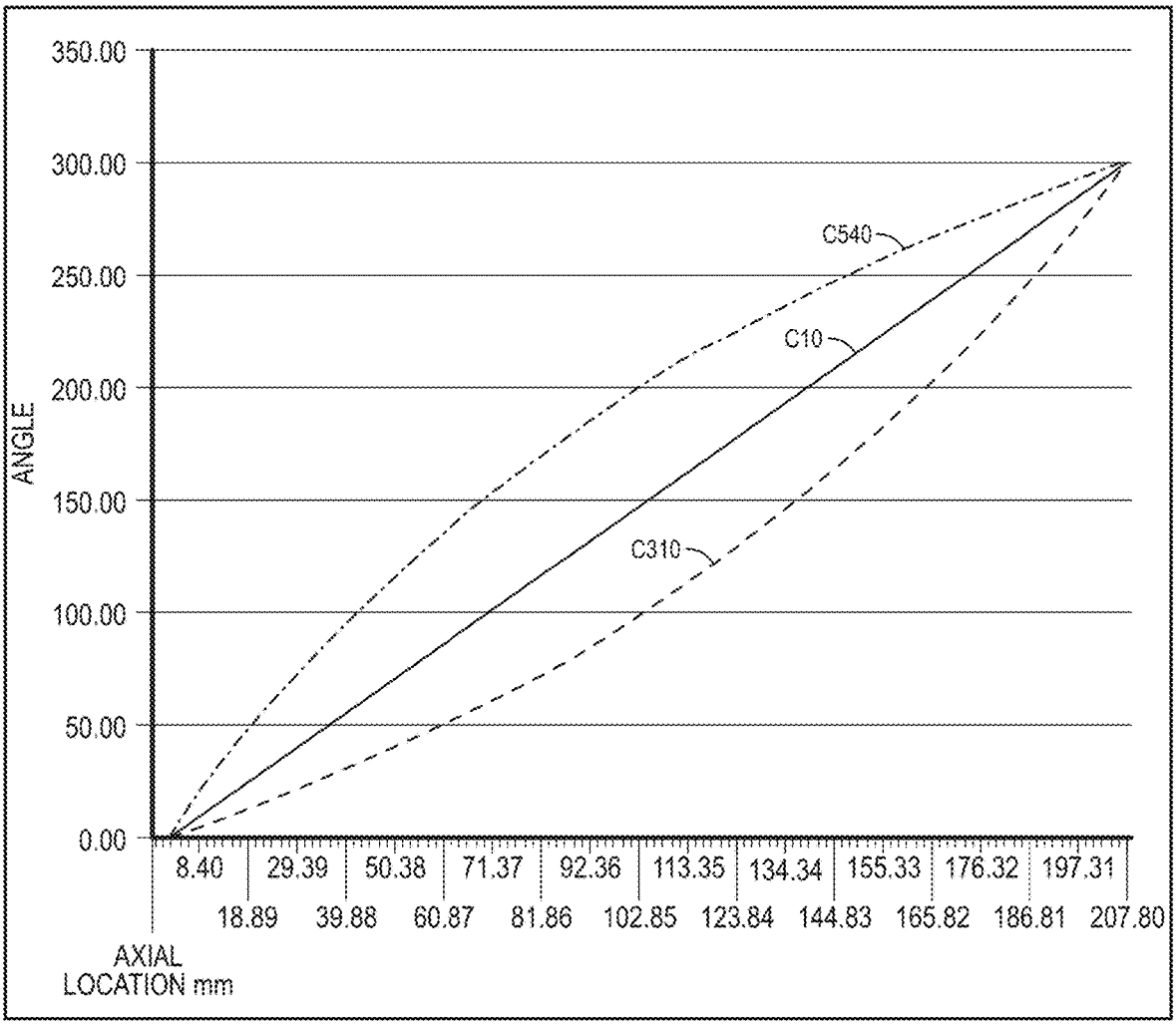
FIG. 24 is a graph showing the wrap-angle curve of the male rotors of FIG. 1, FIG. 16, and a Fast Slow helix male rotor.

FIG. 24 shows a graph of the wrap angle of the male constant helical rotor C10, the wrap angle curve of the male continuously variable helical rotors C310, and the wrap angle curve of a Fast Slow (FS) variable helical rotor C540. As shown the FS curve C540 has a convex curve that slowly decreases toward a horizontal line. The FS variable helical rotor accordingly has a negative change in slope along the length of the curve C540. The rate of the change in the slope can vary at a constant rate or a non-constant rate.

Figure 25:
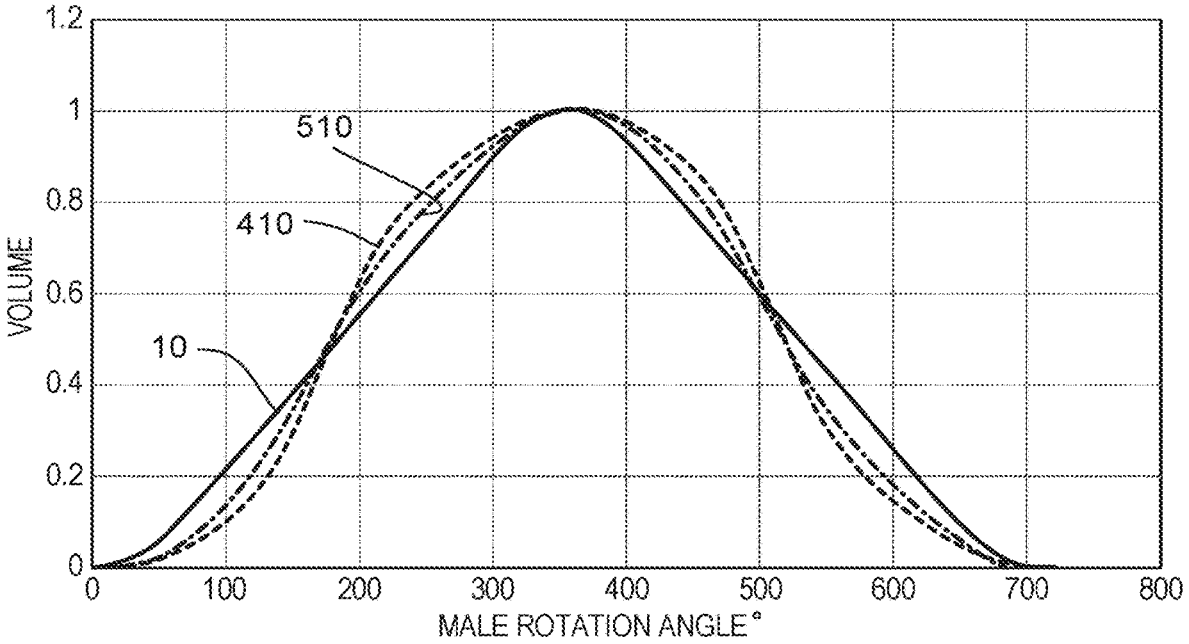
FIG. 25 is a graph showing volume vs male rotation angle.
Figure 26:
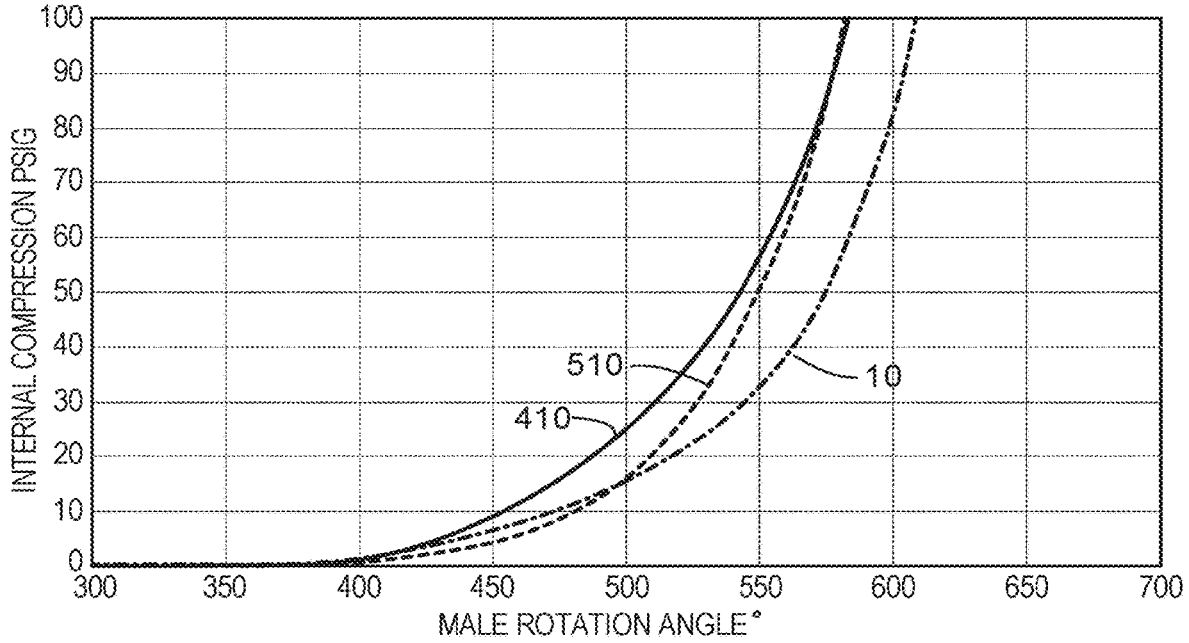
FIG. 26 is a graph showing compression vs male rotation angle.

Varying the helical pattern of the rotors as discussed above can provide a number of advantages over the constant helical rotor or a continuously variable helical rotor. FIG. 25 shows the volume of the fluid vs the rotation angle of the male rotors for the constant helix 10, the FSF helix 410, and the FrSrFr helix 510. The inlet volume increases faster for the variable profile rotors 410, 510 and reduces faster after the maximum volume and the fluid begins to compress. FIG. 26 shows the internal compression vs the rotation angle of the male rotors of the constant helix 10, the continuously variable helix 310, and the FSF helix 410. The FSF helix 410 has less pressure when the cells are within the inlet end clearance, resulting in lower leakage. The FSF helix 510 also keeps the cell pressure lower for a given rotation angle lowering leakage. FIG. 26 also shows that the discharge pressure can be reached sooner than the constant helix 10.

Other advantages can include decreased leakage due to a reduction in the sealing line length. The sealing line of a rotor is considered the line of closest proximity between intermeshed lobes and grooves. Because the rotors are not in direct contact with one another, the sealing line represents the closed point of contact and is determinative of the amount of leakage that will occur between intermesh rotors. The variable helical profile has a decreasing sealing line length from the inlet end of the compressor to the discharge end. For the same rotation angle of the groove, the sealing line for a given cell is shorter in the variable helix rotor than in the fixed helix rotor, resulting in less leakage. The reduction of the sealing line length is in a position where greater pressure is developed and gas leakage is most critical. Other advantages of the rotors include increased discharge port area and improved high speed performance.

Double Helix

Figure 27:
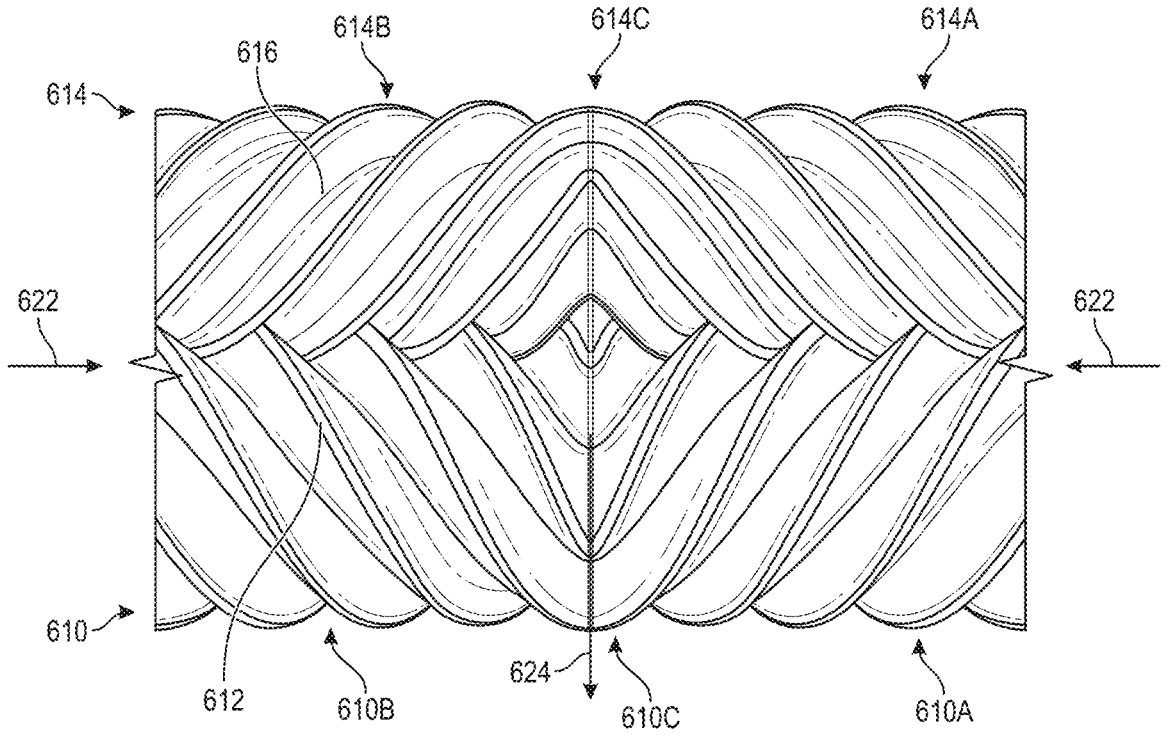
FIG. 27 shows a top view of an exemplary double helix rotor.

Other exemplary embodiments are directed to a set of rotors having a double helix configuration. FIG. 27 shows an exemplary embodiment of a compressor design that includes a male rotor 610 having one or more lobes 612 and a female rotor 614 having one or more grooves or gates 616. The male and female rotors 610, 614 can be mounted on shafts that are rotatably positioned in a housing 620 that at least partially defines a compression chamber. The male rotor 610 is positioned in a first section of the compression chamber and the female rotor 614 is positioned in a second section of the compression chamber.

The male and female rotors 610, 614 each have a double helix configuration. The male rotor 610 includes a first section 610A having a left-hand helical profile and a second section 610B having a right-hand helical profile. The first and second sections 610A, 610B of the male rotor 610 meet at a central section 610C. Similarly, the female rotor 614 includes a first section 614A having a right-hand helical profile and a second section 614B having a left-hand helical profile, with the first and second sections 614A, 614B meeting at a central section 614C. Inlet portions 622 are provided at both ends of the rotors 610, 614 and a discharge portion 624 is positioned in the central sections 610C, 614C of the rotors 610, 614.

Figure 28:
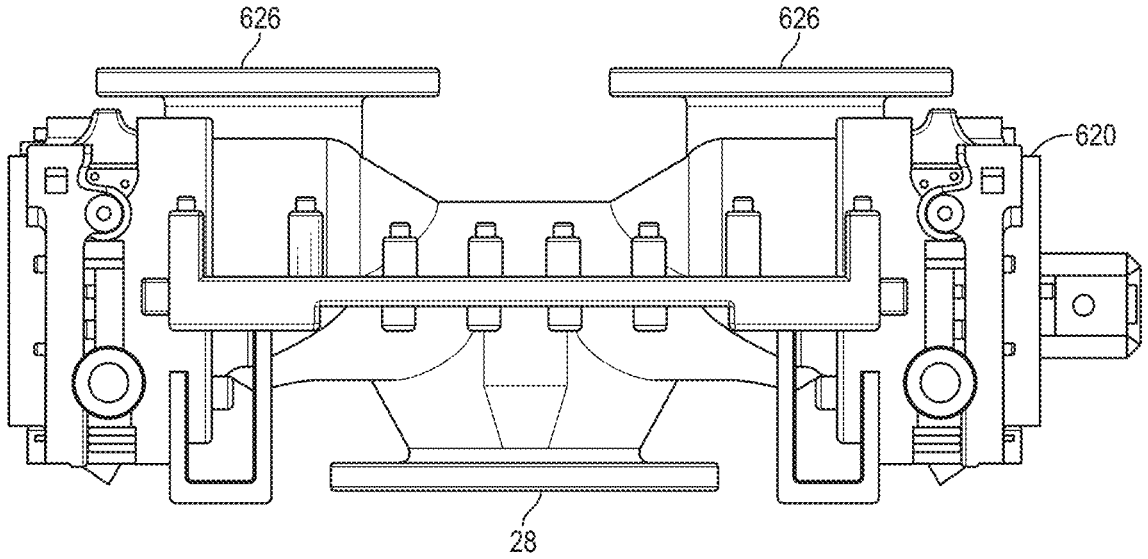
FIG. 28 shows a side view of an exemplary compressor or expander housing.

FIG. 28 shows an exemplary embodiment of a housing 620 that can be used with a double helix rotor. The housing 620 includes a pair of inlet ports 626 positioned near each end and a discharge port 628 positioned in a central region, for example aligned with the discharge portion 624 of the male and female rotors 610, 614. Fluid enters the chamber at the inlet ports 626 and when the rotors are driven, the lobes 612 of the male rotor 610 fit into the grooves 616 of the female rotor 614, causing compression and movement of the fluid towards the outlet or discharge portion 624 where the compressed fluid is discharged through the discharge port 628. The male and female rotors 610, 614 have a constant lead or pitch extending along the length of the rotor, a constant profile, and a constant outer diameter. Accordingly the chamber is defined by a pair of intersecting cylinders that have parallel longitudinal axes.

Figure 29:
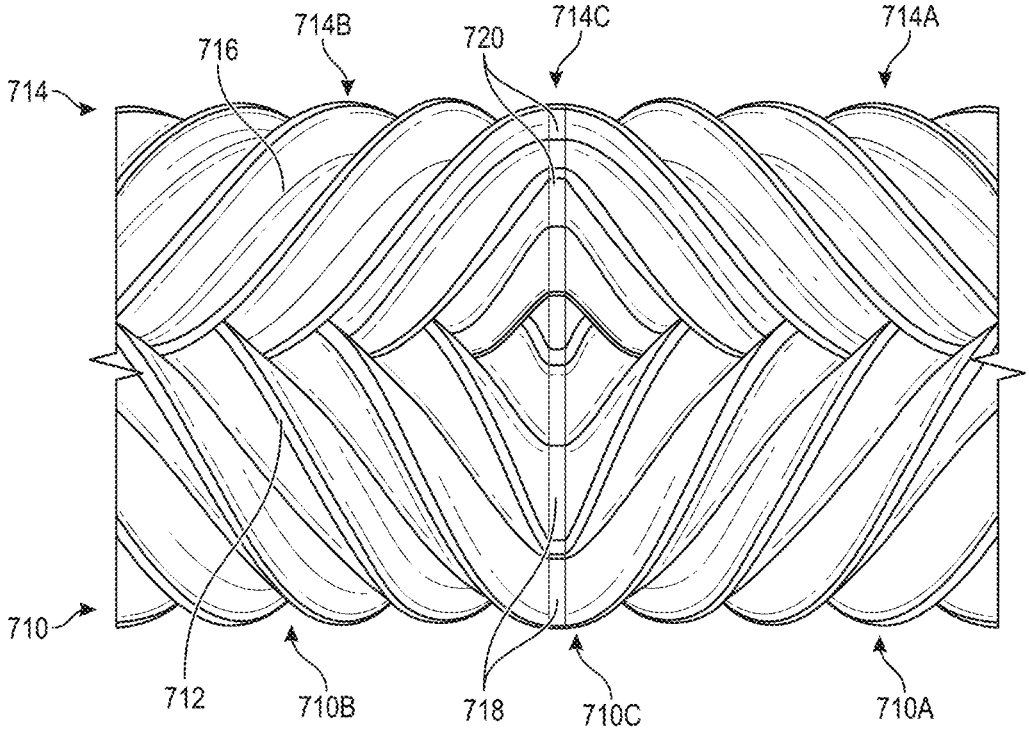
FIG. 29 shows a top view of an exemplary set of double helix rotors with a curved transition.
Figure 30:
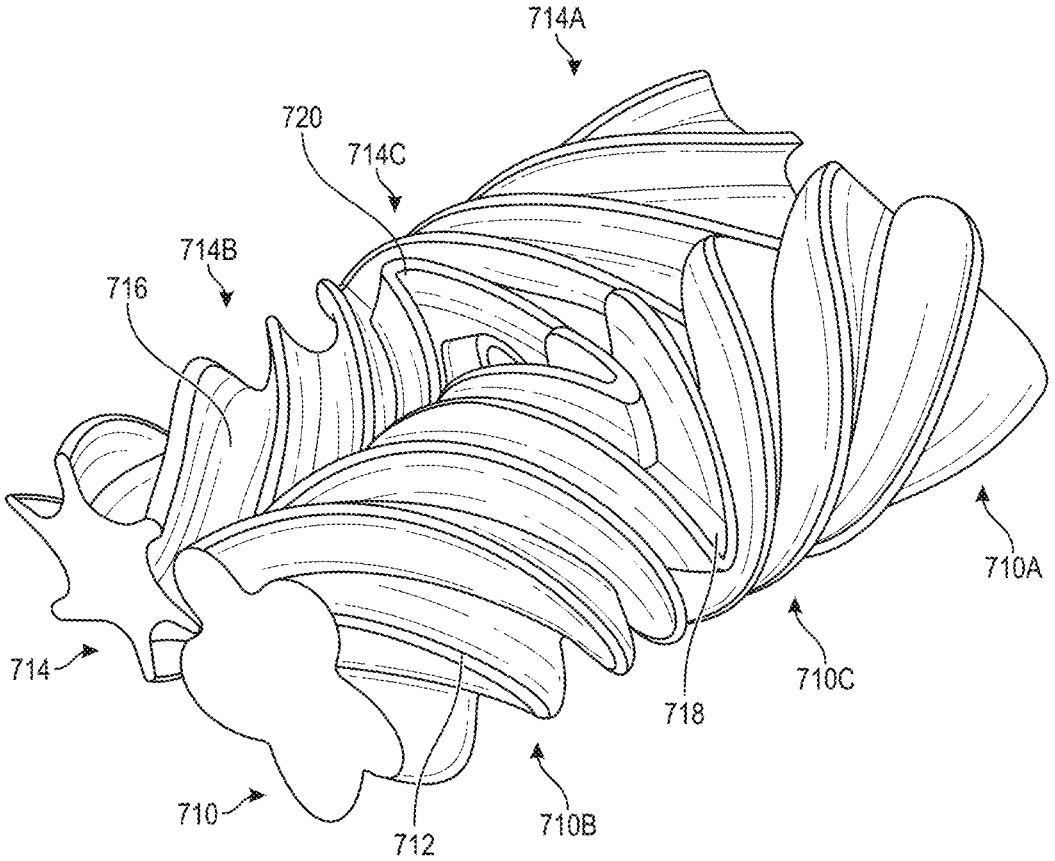
FIG. 30 shows a perspective view of FIG. 29.
Figure 31:
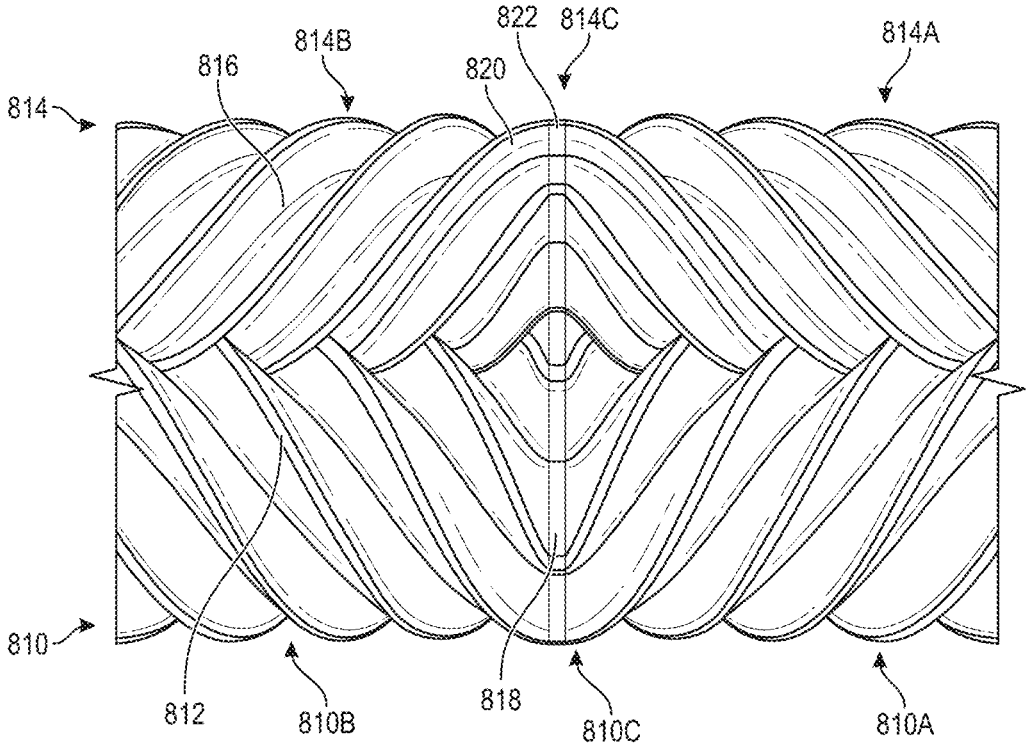
FIG. 31 shows a top view of an exemplary set of double helix rotors with a curved transition and a pocket.
Figure 32:
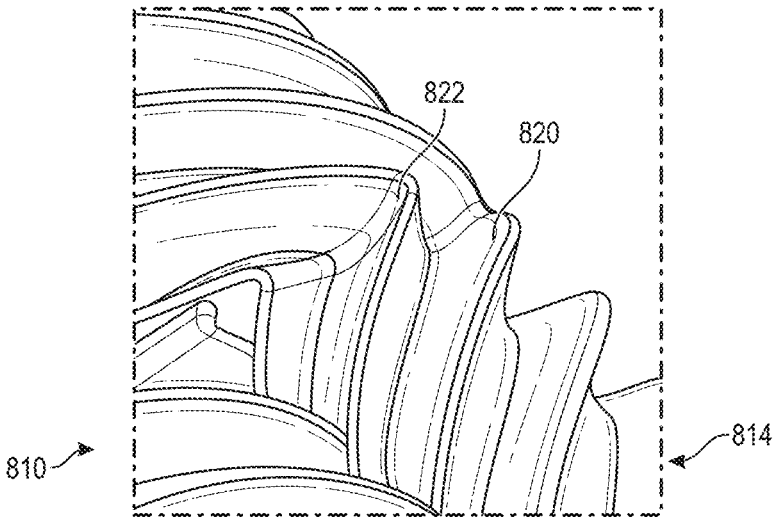
FIG. 32 is an enlarged view of the pocket area of FIG. 31.

FIGS. 29 and 30 show a double helix design where the male rotor 710 includes a first section 710A having a left-hand helical profile and a second section 710B having a right-hand helical profile. The first and second sections 710A, 710B of the male rotor 710 meet at a central section 710C. Similarly, the female rotor 714 includes a first section 714A having a right-hand helical profile and a second section 714B having a left-hand helical profile, with the first and second sections 714A, 714B meeting at a central section 714C. The male rotor central section 710C includes a set of curved transitions 718 between the first section 710A and the second section 710B and the female rotor 714 includes a set of curved transitions 720 between the first section 714A and the second section 714B. The curved transitions 718, 720 can have a circular or U-shaped configuration depending on the helical profile of the rotors 710, 714. This is in contrast to the double helix design 610 shown in FIG. 27, where the central section of the male and female rotors 610C, 614C is essentially a line where the two sections meet, providing a sharp transition between the first sections 610A, 614A, and the second sections 610B, 614B.

Figure 33:
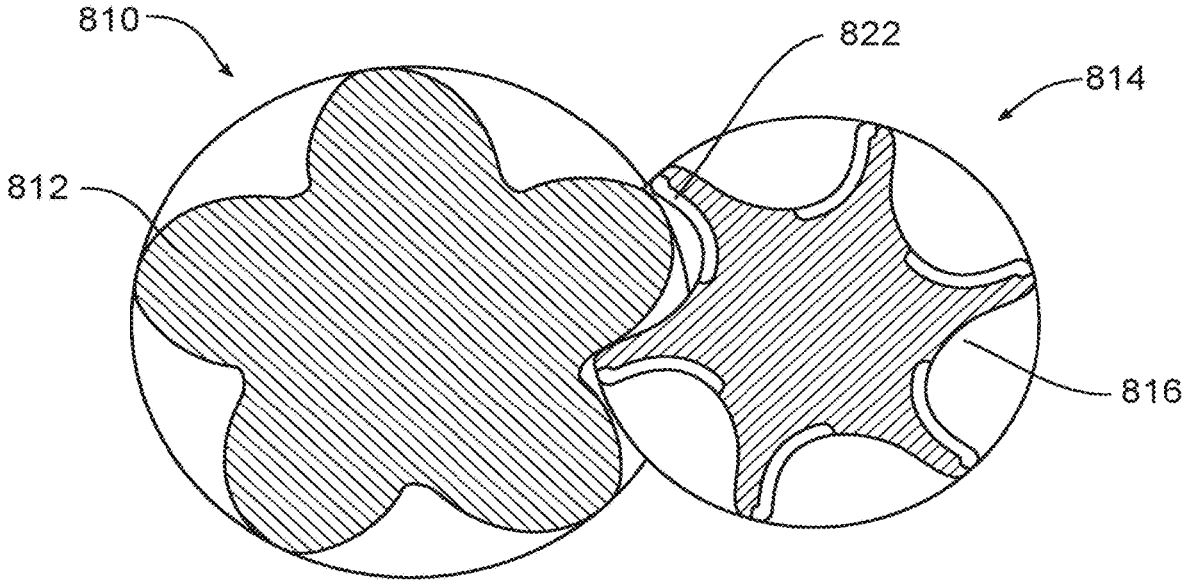
FIG. 33 is a side cross section of the rotors of FIG. 31 in a first position.
Figure 34:
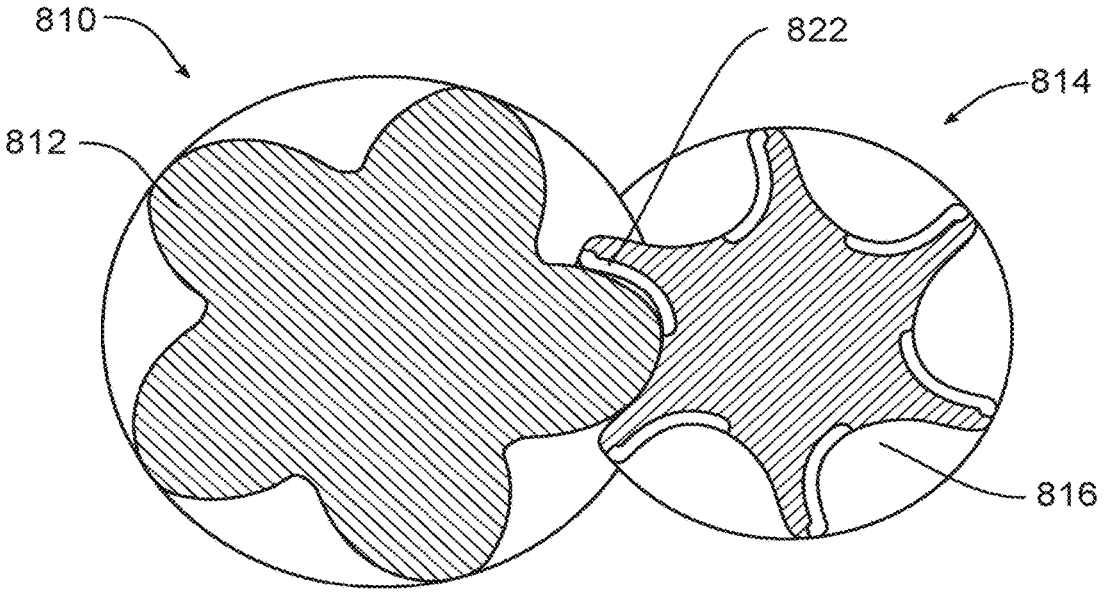
FIG. 34 is a side cross section of the rotors of FIG. 31 in a second position.

FIGS. 31-34 show a double helix design where the male rotor 810 includes a first section 810A having a left hand-helical profile and a second section 810B having a right-hand helical profile. The first and second sections 810A, 810B of the male rotor 810 meet at a central section 810C. Similarly, the female rotor 814 includes a first section 814A having a right hand helical profile and a second section 814B having a left hand helical profile, with the first and second sections 814A, 814B meeting at a central section 814C. The male rotor central section 810C includes a set of curved transitions 818 between the first section 810A and the second section 810B and the female rotor 814 includes a set of curved transitions 820 between the first section 814A and the second section 814B. According to various exemplary embodiments, at least one of the curved transitions 818, 820 can include a pocket that provides trapped air relief. FIGS. 31-34 show an example where the central section 814C of the female rotor 814 includes a set of curved transitions 820 each having a pocket 822. As fluid is compressed by the male and female rotors 810, 814, a portion of the fluid can become trapped, causing torque spikes and high pressure and temperature areas. The pocket 822 allows fluid to be directed to the discharge, helping to reduce or prevent trapped air from disrupting operation. The pocket 822 can be formed in only a portion of each groove 816 for example in the upper or trailing half of the groove 816 as best shown in FIGS. 33 and 34.

Using a double helix as shown above can provide a number of advantages. Larger displacement can be achieved for a given rotor center distance. Positioning the air inlet on both sides of the compressor with a single, central discharge point can eliminate the need for a discharge end clearance which can reduce leakage and increase performance. The double helix configuration can reduce or eliminate the axial load on the rotors, which typically results from the compressed air pressing in a single direction. The air inlet on both sides can also cool the bearings and simplify the sealing at the ends of the rotors due to the reduced heat and pressure. In various exemplary embodiments, a herringbone gear is used to maintain no axial load, for example with a dry compressor or blower. The housing can also be simplified as both ends can mirror each other and the axial bearing can be eliminated. The rotors can be driven from either end. In various embodiments, a single intake port can deliver fluid to both ends.

Advantages of using the double helix configuration can include lower leakage and higher performance. The double helix configuration can also result in higher efficiency, cost reduction, for example due to the simplified assembly, and easier maintenance.

Combination Rotors

Figure 35:
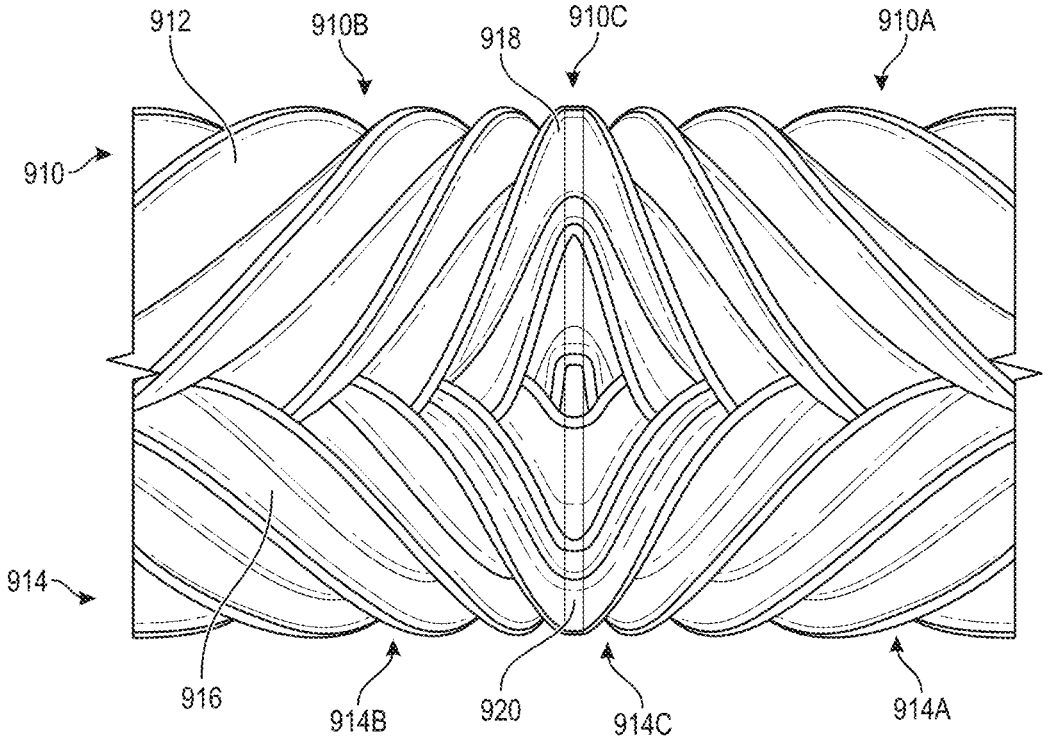
FIG. 35 is a top view of an exemplary set of variable double helix rotors.

Various exemplary embodiments are directed to combining one or more of the rotor features discussed above. For example, a combination of the variable helix features discussed with respect to FIGS. 16-26 and the double helix features discussed with respect to FIGS. 27-34 can be combined to create a rotor combination that has a variable double helix. FIG. 35 shows an exemplary embodiment of a variable double helix design where the male rotor 910 includes a first section 910A having a right-hand helical profile and a second section 910B having a left-hand helical profile. The first and second sections 910A, 910B of the male rotor 910 meet at a central section 910C. Similarly, the female rotor 914 includes a first section 914A having a left-hand helical profile and a second section 914B having a right-hand helical profile, with the first and second sections 914A, 914B meeting at a central section 914C. The male rotor central section 910C includes a set of curved transitions 918 between the first section 910A and the second section 910B and the female rotor 914 includes a set of curved transitions 920 between the first section 914A and the second section 914B. The curved transitions 918, 920 can have a circular or U-shaped configuration. The right hand helix sections 910A, 914A and the left hand helix sections 910B, 914B can have any of the variable helix profiles discussed above or other helical profiles that can be developed from the teachings herein.

Figure 36:
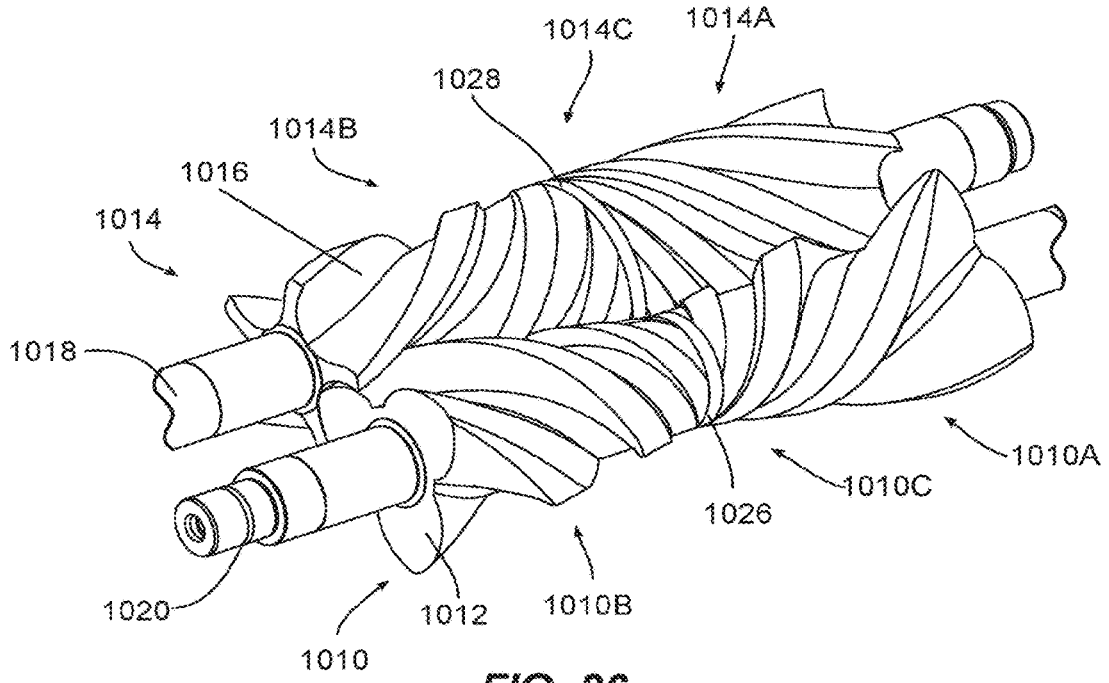
FIG. 36 is perspective view of an exemplary set of double helix, variable profile rotors.
Figure 37:
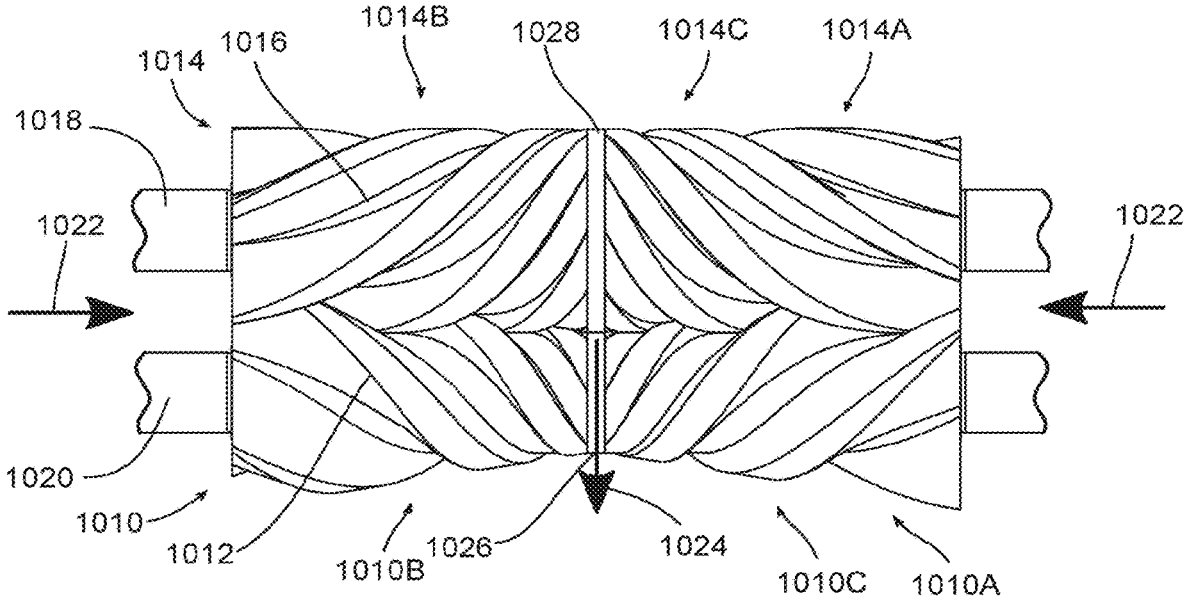
FIG. 37 is a top view of FIG. 36.

In other embodiments, the variable profile features discussed with respect to FIGS. 1-15 and the double helix features discussed with respect to FIGS. 27-34 can be combined to create a rotor combination that has a double helix with a variable profile. FIGS. 36 and 37 show an exemplary embodiment of a double helix rotor combination with a variable profile, where the male rotor 1010 includes a first section 1010A having a left-hand helical profile and a second section 1010B having a right-hand helical profile. The first and second sections 1010A, 1010B of the male rotor 1010 meet at a central section 1010C. Similarly, the female rotor 14 includes a first section 1014A having a right-hand helical profile and a second section 1014B having a left-hand helical profile, with the first and second sections 1014A, 1014B meeting at a central section 1014C. The male rotor 1010 is mounted on a first shaft 1018 and the female rotor 1014 is mounted on a second shaft 1020. The rotors have a first and second inlet portions 1022 and an outlet portion 1024 in the central sections 1010C, 1014C.

The profile of lobes 1012 and grooves 1016 varies between the first and second inlet portions 1022 and the outlet portion 1024, as does the outer diameter of the male rotor 1010 and the female rotor 1012, while the rotation axis of the two rotors is maintained substantially parallel. The outer diameter of the male and female rotors can be decreased in a conical configuration, an ogive configuration, a complex curve configuration, or any other type of configuration according to the teachings herein.

In an exemplary embodiment, the male rotor 1010 profile is varied down to a substantially cylindrical portion 1026 and the female rotor is varied down to a substantially cylindrical portion 1028. In some exemplary embodiments, the addendum of the male and female rotors 1010, 1014 is reduced to substantially zero, with the outer diameter substantially equaling the pitch diameter. The male and female cylindrical portions 1026, 1028 can be used as a bearing surface for a journal bearing support in a housing.

Figure 38:
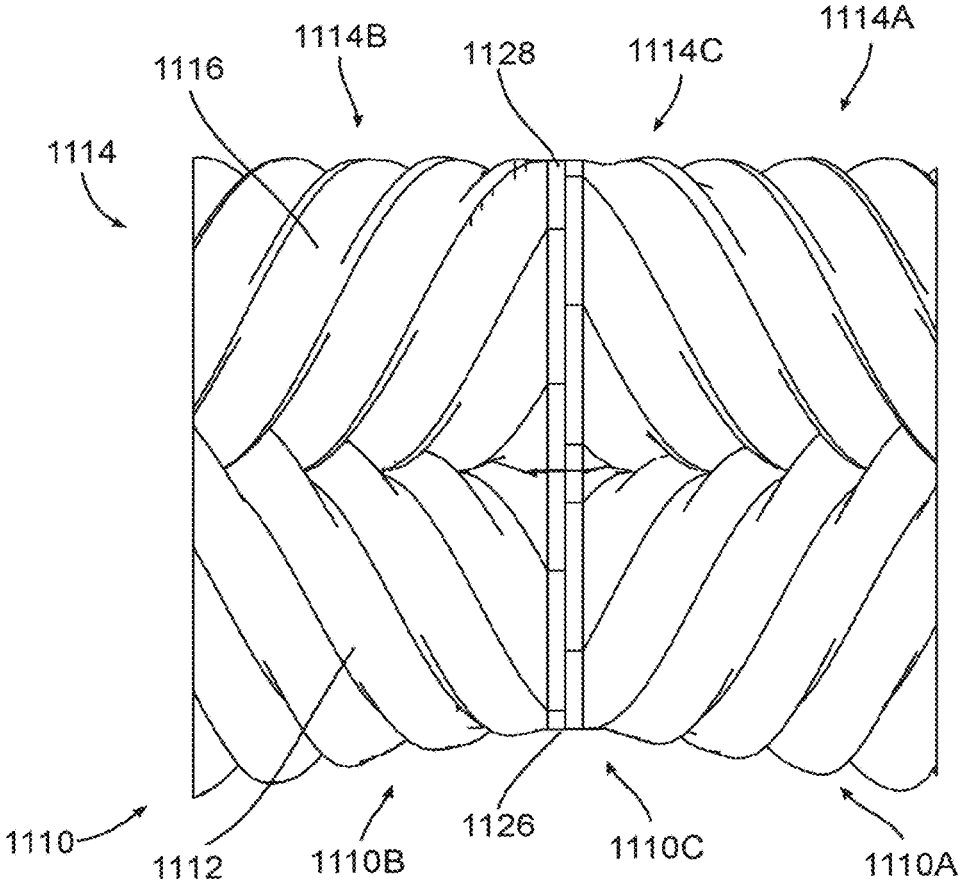
FIG. 38 is a top view of an exemplary set of double helix variable profile rotors where the lobes and grooves are offset.

FIG. 38 shows another exemplary embodiment of a double helix rotor combination with a variable profile, where the male rotor 1110 includes a first section 1110A having a left-hand helical profile and a second section 1110B having a right-hand helical profile. The first and second sections 1110A, 1110B of the male rotor 1110 meet at a central section 1110C. Similarly, the female rotor 1114 includes a first section 1114A having a right hand helical profile and a second section 1114B having a left hand helical profile, with the first and second sections 1114A, 1114B meeting at a central section 1114C.

Figure 38A:
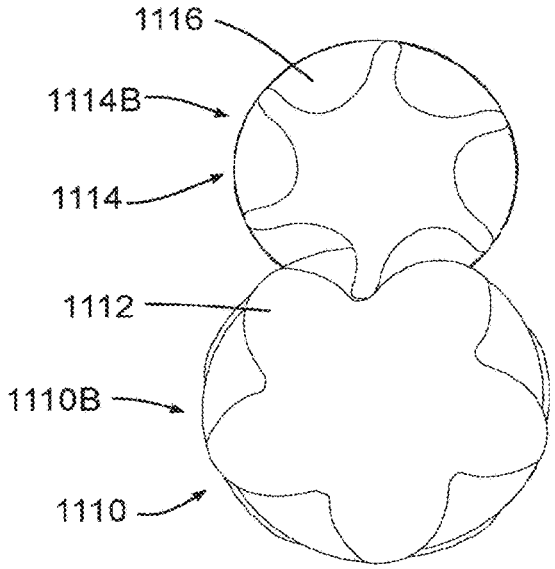
FIG. 38A is a left side view of FIG. 38.
Figure 38B:
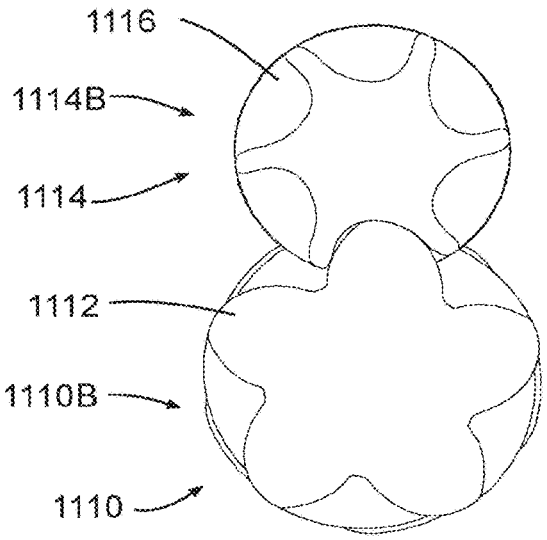
FIG. 38B is a right side view of FIG. 38.

The profile of lobes 1112 and grooves 1116 varies between the first and second inlet portions 1122 and the outlet portion 1124, as does the outer diameter of the male rotor 1110 and the female rotor 1112, while the rotation axis of the two rotors is maintained substantially parallel. The male rotor 1110 profile is varied down to a substantially cylindrical portion 1126 and the female rotor 1114 is varied down to a substantially cylindrical portion 1128. In this embodiment, the lobes 1112 and grooves 1116 on the right hand portions of the rotors 1110A, 1114A are offset from the corresponding lobes 1112 and grooves 1116 on the left hand portions of the rotors 1110B, 1114B. For example, the male rotor first and second sections 1110A, 1110B can each include five equally spaced lobes 1112. In the configuration shown in FIGS. 36 and 37 the lobes 1012 in the first section 1010A and the lobes in the second section 1010B start and end at equivalent angular positions. In FIG. 38, however, the lobes 1112 in the first section 1110A and the lobes 1112 in the second section 1110B end in offset angular positions. In some embodiments the lobes 1112 can also start in offset angular positions, as best shown in FIGS. 38A and 38B. FIG. 38A shows a first end of the rotors 1110, 1114 while FIG. 38B shows the second end of the rotors 1110, 1114, with the rotors in the same relative position as shown in FIG. 38. In an exemplary embodiment, the offset is a by approximately half the lobe as shown in FIG. 38, although other degrees or amounts of offset can also be used. This offset can help reduce or eliminate pressure and velocity pulses that can generate unwanted noise.

Figure 39:
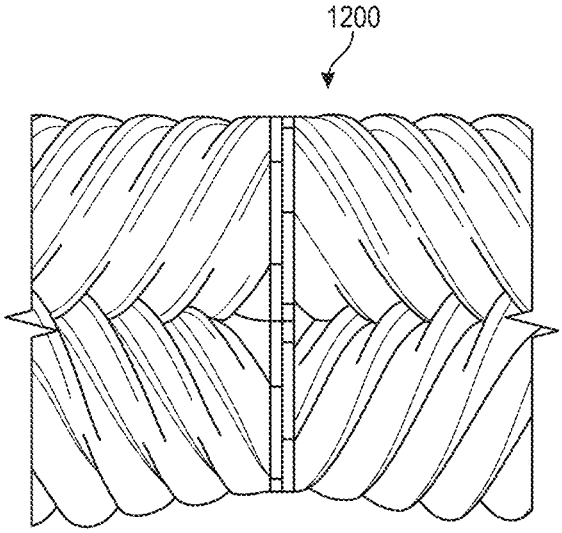
FIG. 39 shows an example of a set of rotors having a fixed double helix and a conical rotor profile.
Figure 40:
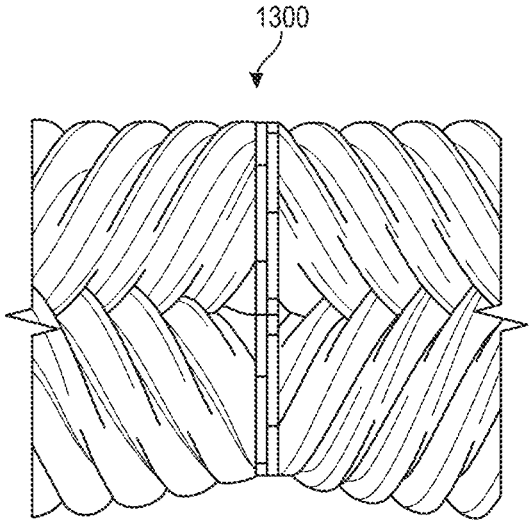
FIG. 40 shows an example of a set of rotors having a fixed double helix and a rounded or ogive rotor profile.
Figure 41:
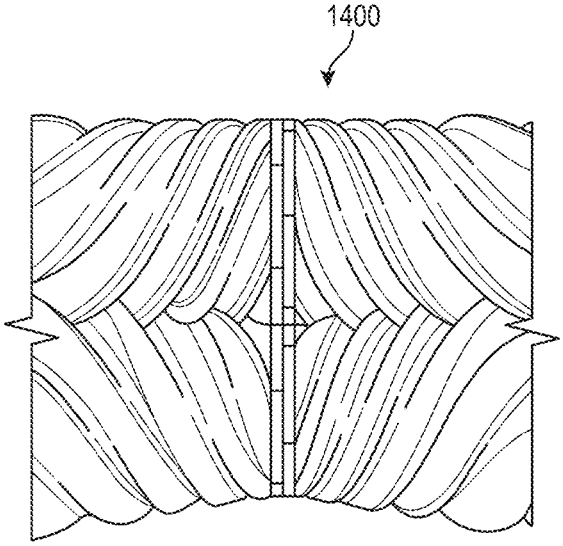
FIG. 41 shows an example of a set of rotors having a variable double helix and a conical rotor profile where both sides of the helix are a continuously variable helix having a concave wrap-angle curve.
Figure 42:
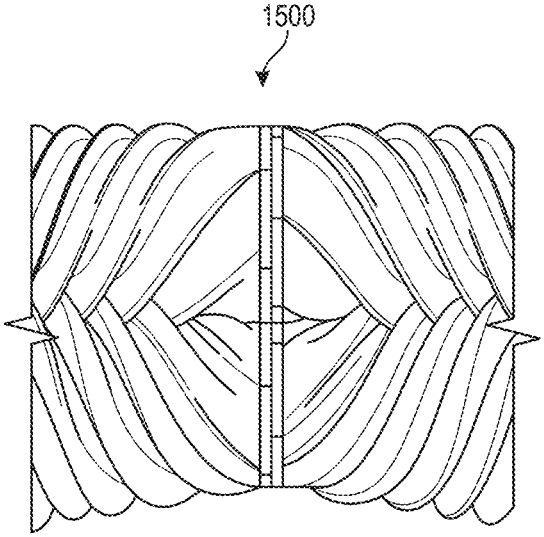
FIG. 42 shows an example of a set of rotors having a variable double helix and a conical rotor profile where both sides of the helix are a Fast Slow variable helix having a convex wrap-angle curve.
Figure 43:
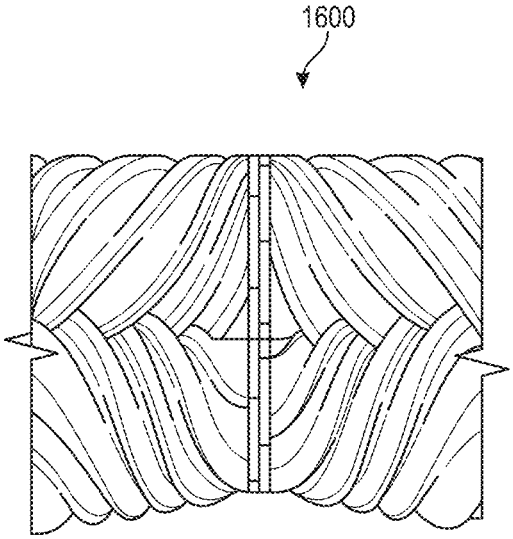
FIG. 43 shows an example of a set of rotors having a conical rotor profile where both sides of the helix are a Slow Fast Slow non-continuously variable helix.
Figure 44:
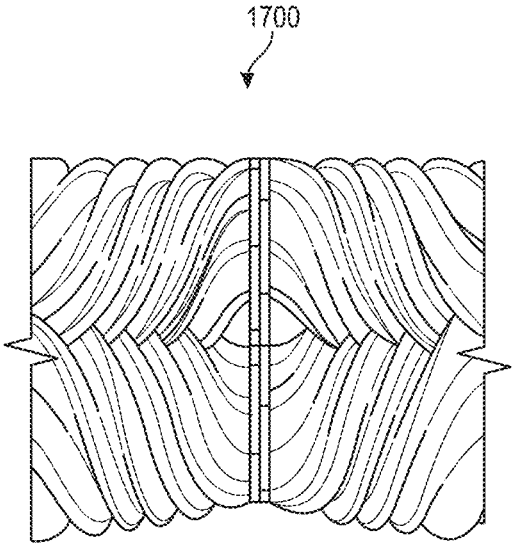
FIG. 44 shows an example of a set of rotors having an ogive rotor profile where both sides of the helix are a Slow Fast Slow non-continuously variable helix.
Figure 45:
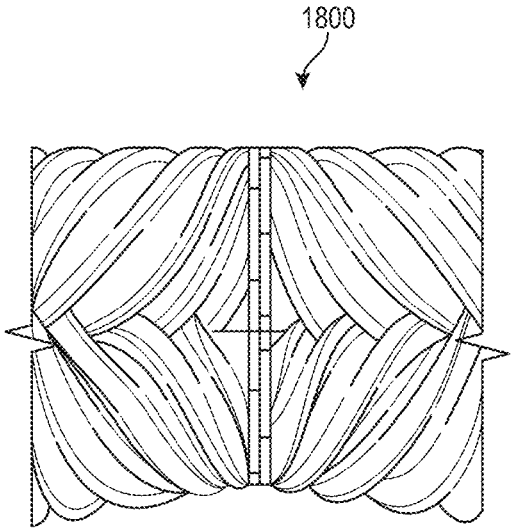
FIG. 45 shows an example of a set of rotors having a conical rotor profile where both sides of the helix are a Fast Slow Fast non-continuously variable helix.
Figure 46:
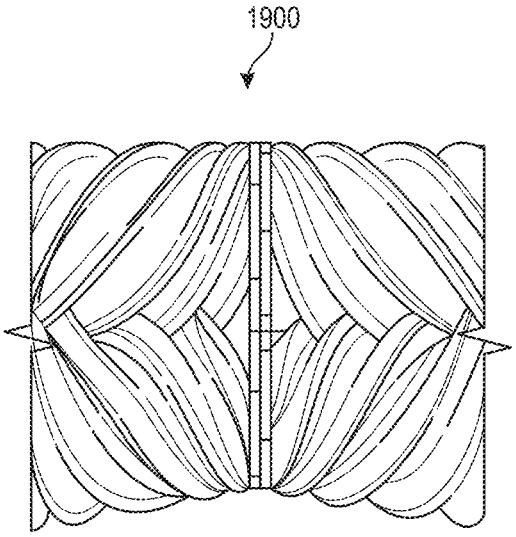
FIG. 46 shows an example of a set of rotors having an ogive rotor profile where both sides of the helix are a Fast Slow Fast non-continuously variable helix.

FIG. 39 shows an example of a set of rotors 1200 having a fixed double helix and a conical rotor profile. FIG. 40 shows an example of a set of rotors 1300 having a fixed double helix and a rounded or ogive rotor profile. In other embodiments, the variable profile features discussed with respect to FIGS. 1-15 the variable helix features discussed with respect to FIGS. 16-26, and the double helix features discussed with respect to FIGS. 27-34 can be combined to create a rotor combination that has a variable double helix with a variable profile. FIG. 41 shows an example of a set of rotors 1400 having a variable double helix and a conical rotor profile where both sides of the helix are a continuously variable helix having a concave wrap-angle curve. FIG. 42 shows an example of a set of rotors 1500 having a variable double helix and a conical rotor profile where both sides of the helix are a FS variable helix having a convex wrap-angle curve. FIG. 43 shows an example of a set of rotors 1600 having a conical rotor profile where both sides of the helix are a SFS non-continuously variable helix. FIG. 44 shows an example of a set of rotors 1700 having an ogive rotor profile where both sides of the helix are a SFS non-continuously variable helix. FIG. 45 shows an example of a set of rotors 1800 having a conical rotor profile where both sides of the helix are a FSF non-continuously variable helix. FIG. 46 shows an example of a set of rotors 1900 having an ogive rotor profile where both sides of the helix are a FSF non-continuously variable helix.

The combination rotors shown in FIGS. 35-46 can provide all or some of the advantages described above with respect to each individual rotor. Additionally, the variable profile and helix angle allow the discharge port to be properly sized for a dual helix compressor.

Although some combinations of the exemplary embodiments are specifically shown and described, applicant understands that other combinations of the exemplary embodiments can also be made.

The foregoing detailed description of the certain exemplary embodiments has been provided for the purpose of explaining the principles of the application and examples of practical implementation, thereby enabling others skilled in the art to understand the disclosure for various embodiments and with various modifications as are suited to the particular use contemplated. This description is not necessarily intended to be exhaustive or to limit the application to the exemplary embodiments disclosed. Any of the embodiments and/or elements disclosed herein may be combined with one another to form various additional embodiments not specifically disclosed. Accordingly, additional embodiments are possible and are intended to be encompassed within this specification and the scope of the appended claims. The specification describes specific examples to accomplish a more general goal that may be accomplished in another way.

As used in this application, the terms "front," "rear," "upper," "lower," "upwardly," "downwardly," and other orientational descriptors are intended to facilitate the description of the exemplary embodiments of the present application, and are not intended to limit the structure of the exemplary embodiments to any particular position or orientation. Terms of degree, such as "substantially" or "approximately" are understood by those of ordinary skill to refer to reasonable ranges outside of the given value, for example, general tolerances associated with manufacturing, assembly, and use of the described embodiments.

Various exemplary embodiments relate to a screw compressor or expander comprising: a female rotor including a first section having a right-hand first groove and a second section having a left-hand second groove, wherein the first groove has a first variable helix, the second groove has a second variable helix, and the female rotor has a first variable profile and a first variable outer diameter; and a male rotor including a third section having a left-hand first lobe and a fourth section having a right-hand second lobe, wherein the first lobe has a third variable helix, the second lobe has a fourth variable helix, and the male rotor has a second variable profile and a second variable outer diameter.

The screw compressor or expander, wherein the first and third variable helix each include a fast-slow-fast transition. The screw compressor or expander, wherein the first and third variable helix each include a slow-fast-slow transition. The screw compressor or expander, wherein a wrap-angle curve of the first section includes a convex portion and a concave portion. The screw compressor or expander, wherein the female rotor includes a first central section positioned between the first section and the second section and the male rotor includes a second central section positioned between the third section and the fourth section. The screw compressor or expander, wherein the first and second section of the female rotor and the third and fourth section of the male rotor each have a conical configuration in which the outer diameters of the female and male rotors each decrease in a linear fashion toward the first and second central sections respectively. The screw compressor or expander, wherein the first and second section of the female rotor and the third and fourth section of the male rotor each have a curvilinear configuration in which the outer diameter of the female and male rotors each decrease in a curved fashion toward the first and second central sections, respectively. The screw compressor or expander, wherein the outer diameter of the male rotor equals a male rotor pitch diameter at the second central section. The screw compressor or expander of claim 5, wherein the female rotor transitions to a substantially circular cross section at the first central section and the male rotor transitions to a substantially circular cross section at the second central section. The screw compressor or expander, wherein the female rotor has a first axis of rotation and the male rotor has a second axis of rotation that is parallel to the first axis of rotation. The screw compressor or expander, wherein the first and second lobes are corresponding lobes and the first lobe is angularly offset from the second lobe.

Various exemplary embodiments relate to a screw compressor or expander comprising: a female rotor including a first section, a second section, and a first central section, the first section having a set of right-hand first grooves, the second section having a set of left-hand second grooves corresponding to the set of first grooves, wherein the first grooves have a first variable helix, the second grooves have a second variable helix, and the female rotor has a first variable profile; and a male rotor including a third section, a fourth section, and a second central section positioned between the third and fourth sections, the third section having a set of left-hand first lobes and the fourth section having a set of right-hand second lobes corresponding to the set of first lobes, wherein the first lobes have a third variable helix, the second lobes have a fourth variable helix, and the male rotor has a second variable profile, wherein the female rotor transitions to a substantially circular cross section at the first central section and the male rotor transitions to a substantially circular cross section at the second central section.

The screw compressor or expander, wherein the lobes of the first set of lobes corresponding to the lobes of the second set of lobes are angularly offset. The screw compressor or expander, wherein the lobes of the first set of lobes corresponding to the lobes of the second set of lobes are offset by a half a lobe rotation. The screw compressor or expander, further comprising a housing having a journal bearing engaging at least the first center section.

Various exemplary embodiments relate to a screw compressor or expander comprising: a female rotor including a first section having a first groove with a right-hand first variable helical profile and a second section having a second groove with a left-hand second variable helical profile; and a male rotor including a third section having a first lobe with a right-hand third variable helical profile and a fourth section having a second lobe with a left-hand fourth variable helical profile.

The screw compressor or expander, wherein the female rotor includes a first curved transition connecting the first and second groove in a first central section and the male rotor includes a second curved transition connecting the first and second lobes in a second central section. The screw compressor or expander, wherein the first, second, third and fourth variable helical profiles are each non-continuously variable. The screw compressor or expander, wherein the first, second, third and fourth variable helical profiles are each continuously variable.

Various exemplary embodiments relate to a screw compressor or expander comprising: a male rotor having a first axial length extending from an inlet portion to an outlet portion and a set of lobes with a variable profile extending along the first axial length; and a female rotor having a second axial length extending from the inlet portion to the outlet portion and a set of grooves with a variable profile extending along the second axial length, the set of grooves mating with the set of lobes, wherein at least a portion of the male rotor and the female rotor each have a non-cylindrical configuration with a non-constant outer diameter.

The screw compressor or expander of, wherein the male rotor and the female rotor each have a conical configuration in which the outer diameters of the female and male rotors each decrease in a linear fashion along at least a portion of the respective axial length from the inlet portion to the outlet portion. The screw compressor or expander, wherein the male rotor and the female rotor have an ogive configuration where the outer diameter of the rotor decreases in an arc along at least a portion of the respective axial length from the inlet portion to the outlet portion. The screw compressor or expander, wherein the male rotor and the female rotor each have a complex curve configuration in which the outer diameter of the rotor decreases in a curve having at least two different radii of curvature along at least a portion of the respective axial length from the inlet portion to the outlet portion. The screw compressor or expander, wherein the addendum of the male rotor and of the female rotor decreases along the first axial length. The screw compressor or expander, wherein the outer diameter of the male rotor equals a male rotor pitch diameter at the outlet portion. The screw compressor or expander, wherein a tip width of the male lobes widens along at least a portion of the axial length from the inlet portion to the outlet portion. The screw compressor or expander, further comprising a compression chamber having a non-cylindrical first portion and a non-cylindrical second portion. The screw compressor, wherein the non-cylindrical second portion has a substantially conical configuration. The screw compressor, wherein the non-cylindrical second portion has a substantially ogive configuration. The screw compressor or expander, wherein a rotation axis of the male rotor and a rotation axis of the female rotor are parallel.

Various exemplary embodiments relate to a screw compressor or expander comprising: a male rotor having a first axial length extending from an inlet portion to an outlet portion and a set of lobes with a variable profile extending along at least a portion of the first axial length; and a female rotor having a second axial length extending from the inlet portion to the outlet portion and a set of grooves with a variable profile extending along at least a portion of the second axial length, the set of grooves mating with the set of lobes, wherein the male rotor and the female rotor transition to a substantially circular cross section near the outlet portion.

The screw compressor or expander, wherein the male rotor has a first outer diameter and a first pitch diameter less than the first outer diameter near the inlet portion and a second outer diameter substantially equal to the first pitch diameter at the outlet portion. The screw compressor or expander, wherein the male rotor has a non-constant outer diameter. The screw compressor or expander, wherein the male rotor has a conical configuration where the outer diameter of the rotor decreases in a linear fashion along at least a portion of the first axial length. The screw compressor or expander, wherein the male rotor has a curved configuration where the outer diameter of the rotor decreases in a curved fashion along at least a portion of the first axial length. The screw compressor or expander, wherein a rotation axis of the male rotor and a rotation axis of the female rotor are parallel.

Various exemplary embodiments relate to a screw compressor or expander comprising: a male rotor having a first axial length extending from an inlet portion to an outlet portion and a set of lobes extending along at least a portion of the first axial length; and a female rotor having a second axial length extending from the inlet portion to the outlet portion and a set of grooves extending along at least a portion of the second axial length, the set of grooves mating with the set of lobes, wherein the male rotor and the female rotor have a first section with a first profile defined by a first rack having a first set of X and Y coordinates and a second section with a second profile defined by a second rack different than the first rack having a second set of X and Y coordinates.

The screw compressor or expander, wherein the second rack is scaled from the first rack in the X and Y direction.

Various exemplary embodiments relate to a method of designing a set of screw compressor or expander rotors comprising: establishing a first rack for a male and female rotor, the first rack having at least one curved segment with a first crest having a first set of X and Y coordinates; and scaling the first rack in the X and Y directions to create a second rack having at least one curved segment with a second crest having a second set of X and Y coordinates, wherein the X coordinate of the second crest is spaced from the X coordinate of the first crest.

The method above, further comprising separating the second rack at a portion along the curved segment and offsetting the second rack in the Y direction to create a first inner point, a second inner point, a first end point, and a second end point. The method above, further comprising connecting the first inner point and the second inner point and extending a first end point and the second end point to extend the Y height of the second rack to substantially equal the Y height of the first rack. The method above, further comprising using an interpolation method to connect points on the rack to create the second rack curve. The method above, further comprising scaling the first or second rack in both the X and Y directions to create a third rack having an X coordinate of substantially zero.

Various exemplary embodiments relate to a method of designing a set of screw compressor or expander rotors comprising: establishing a first rack for a male and female rotor, the first rack having at least one curved segment with a first crest having a first set of a X and Y coordinates; and establishing a second rack for a male and female rotor, the second rack having at least one curved segment with a second crest having a second set of a X and Y coordinates, wherein the X coordinate of the second crest is spaced from the X coordinate of the first crest.

The method above, wherein the first rack has a first height in the Y direction and the second rack has a second height in the Y direction equal to the first height. The method above, further comprising using interpolation to define the male and female rotor between the first rack and the second rack.

Various exemplary embodiments relate to a screw compressor or expander comprising: a male rotor having a first axial length and a set of lobes with a first helical profile extending along the first axial length; and a female rotor having a second axial length and a set of grooves with a second helical profile extending along the second axial length, the set of grooves mating with the set of lobes, wherein the first helical profile is non-continuously variable over the first axial length.

The screw compressor or expander, wherein the first helical profile includes a fast-slow-fast transition. The screw compressor or expander, wherein the first helical profile includes a slow-fast-slow transition. The screw compressor or expander, wherein a wrap-angle curve of the male rotor includes a convex portion and a concave portion. The screw compressor or expander, wherein the male rotor has an inlet portion and an outlet portion defining the first axial length. The screw compressor or expander, wherein a wrap-angle curve of the male rotor includes a first point positioned between the inlet portion and the outlet portion and a second point positioned between the first point and the outlet portion, and wherein the slope of a line tangent to the first point is less than the slope of a line tangent to the second point. The screw compressor or expander, wherein the male rotor and the female rotor are rotatably positioned in a housing having an inlet port and an outlet port.

Various exemplary embodiments relate to a screw compressor or expander comprising: a male rotor having a lobe with a first helical profile extending between a first position proximate to an inlet portion and a second position proximate an outlet portion; and a female rotor having a groove with a second helical profile extending between a third position proximate an inlet portion and a fourth position proximate an outlet portion, the groove mating with the lobes, wherein a wrap-angle curve of the male rotor lobe includes a convex portion.

The screw compressor or expander, wherein the wrap-angle includes a first point positioned between the first position and the second position and a second point positioned between the first point and the second position, and wherein the slope of a line tangent to the second point is less than the slope of a line tangent to the first point. The screw compressor or expander, wherein the slope of the lines tangential to each point on the wrap angle curve decreases from the first position to the second position. The screw compressor or expander, wherein the first helical profile includes a slow-fast transition. The screw compressor or expander, wherein the wrap-angle curve further comprises a third point and a fourth point, and the slope of a line tangent to the third point is greater than the slope of a line tangent to the second point. The screw compressor or expander, wherein the third point is positioned between the second point and the second position and the fourth point is positioned between the third point and the second position. The screw compressor or expander, wherein the first helical profile includes a fast-slow-fast transition. The screw compressor or expander, wherein the first helical profile includes a slow-fast-slow transition.

Various exemplary embodiments relate to a screw compressor or expander comprising: a female rotor including a first section having a first groove with a right-hand helical profile, a second section having a second groove with a left-hand helical profile, and a first central section having a first curved transition connecting the first and second groove; and a male rotor including a third section having a first lobe with a right-hand helical profile, a fourth section having a second lobe with a left-hand helical profile, and a second central section having a second curved transition connecting the first and second lobes. The screw compressor or expander, wherein the first and second curved transitions each have a substantially U-shaped configuration.

The screw compressor or expander, wherein the first and second curved transitions each have a substantially rounded configuration. The screw compressor or expander, wherein at least one of the first and second curved transitions includes a pocket. The screw compressor or expander, wherein the pocket is formed in a surface of the first curved transition. The screw compressor or expander, wherein the male rotor includes a first inlet portion, a second inlet portion, and a discharge portion. The screw compressor or expander, further comprising a housing at least partially defining a compression chamber for receiving the male rotor and the female rotor. The screw compressor or expander, wherein the housing includes a first inlet port, a second inlet port, and a discharge port.

Various exemplary embodiments relate to a screw compressor or expander comprising: a female rotor including a first section having a first groove with a right-hand helical profile, a second section having a second groove with a left-hand helical profile, and a first central section; and a male rotor including a third section having a first lobe with a right-hand helical profile, a fourth section having a second lobe with a left-hand helical profile, and a second central section, wherein one of the first and second central sections includes a pocket.

The screw compressor or expander, wherein the first central section includes a first curved transition connecting the first and second groove. The screw compressor or expander, wherein the pocket is formed in the first curved transition. The screw compressor or expander, wherein the second central section includes a second curved transition connecting the first and second lobes. The screw compressor or expander, wherein the male rotor includes a first inlet portion, a second inlet portion, and a discharge portion. The screw compressor or expander, further comprising a housing at least partially defining a compression chamber for receiving the male rotor and the female rotor. The screw compressor or expander, wherein the housing includes a first inlet port, a second inlet port, and a discharge port.

Various exemplary embodiments relate to a screw compressor or expander comprising: a housing having an inlet port, a discharge port, and a body at least partially defining a compression chamber having a first portion and a second portion; a female rotor rotatably positioned in the first portion of the compression chamber, the female rotor including a first section having a first groove with a right-hand helical profile, a second section having a second groove with a left-hand helical profile, and a first central section having a first curved transition connecting the first and second groove; and a male rotor rotatably positioned in the first portion of the compression chamber, the male rotor including a third section having a first lobe with a right-hand helical profile, a fourth section having a second lobe with a left-hand helical profile, and a second central section having a second curved transition connecting the first and second lobes.

The screw compressor or expander, wherein at least one of the first and second curved transitions includes a pocket. The screw compressor or expander, wherein the pocket is formed in the first curved transition. The screw compressor or expander, wherein the first and second curved transitions have a substantially U-shaped configuration. The screw compressor or expander, wherein the housing includes a second inlet port.

What is claimed:

1. A screw compressor or expander comprising:

a female rotor including a first section having a right-hand first groove and a second section having a left-hand second groove, wherein the first groove has a first variable helix, the second groove has a second variable helix, and the female rotor has a first variable profile and a first variable outer diameter; and a male rotor including a third section having a left-hand first lobe and a fourth section having a right-hand second lobe, wherein the first lobe has a third variable helix, the second lobe has a fourth variable helix, and the male rotor has a second variable profile and a second variable outer diameter, wherein the female rotor includes a first central section positioned between the first section and the second section and the male rotor includes a second central section positioned between the third section and the fourth section, and wherein the female rotor transitions to a substantially circular cross section at the first central section and the male rotor transitions to a substantially circular cross section at the second central section.

2. The screw compressor or expander of claim 1, wherein the first and third variable helix each include a fast-slow-fast transition.

3. The screw compressor or expander of claim 1, wherein the first and third variable helix each include a slow-fast-slow transition.

4. The screw compressor or expander of claim 1, wherein a wrap-angle curve of the first section includes a convex portion and a concave portion.

5. The screw compressor or expander of claim 1, wherein the female rotor has a first axis of rotation and the male rotor has a second axis of rotation that is parallel to the first axis of rotation.

6. The screw compressor or expander of claim 1, wherein the first and second lobes are corresponding lobes and the first lobe is angularly offset from the second lobe.

7. A screw compressor or expander comprising:

a female rotor including a first section, a second section, and a first central section, the first section having a set of right-hand first grooves, the second section having a set of left-hand second grooves corresponding to the set of first grooves, wherein the first grooves have a first variable helix, the second grooves have a second variable helix, and the female rotor has a first variable profile; and a male rotor including a third section, a fourth section, and a second central section positioned between the third and fourth sections, the third section having a set of left-hand first lobes and the fourth section having a set of right-hand second lobes corresponding to the set of first lobes, wherein the first lobes have a third variable helix, the second lobes have a fourth variable helix, and the male rotor has a second variable profile, wherein the female rotor transitions to a substantially circular cross section at the first central section and the male rotor transitions to a substantially circular cross section at the second central section.

8. The screw compressor or expander of claim 7, wherein the lobes of the first set of lobes corresponding to the lobes of the second set of lobes are angularly offset.

9. The screw compressor or expander of claim 7, wherein the lobes of the first set of lobes corresponding to the lobes of the second set of lobes are offset by a half a lobe rotation.

10. The screw compressor or expander of claim 7, further comprising a housing having a journal bearing engaging at least the first center section.

* * * * *